US008826837B2

(12) United States Patent
Fujiura et al.

(10) Patent No.: US 8,826,837 B2
(45) Date of Patent: Sep. 9, 2014

(54) DRIVE DEVICE FOR SEWING MACHINE SEWING FRAME

(75) Inventors: Mitsuhiro Fujiura, Nagoya (JP); Teruo Nakanishi, Nagoya (JP); Hirotsugu Uenishi, Nagoya (JP)

(73) Assignee: NSD Corporation, Nagoya-shi (JP)

( * ) Notice: Subject to any disclaimer, the term of this patent is extended or adjusted under 35 U.S.C. 154(b) by 89 days.

(21) Appl. No.: 13/496,549

(22) PCT Filed: Sep. 7, 2010

(86) PCT No.: PCT/JP2010/065330

§ 371 (c)(1),
(2), (4) Date: Mar. 16, 2012

(87) PCT Pub. No.: WO2011/033969

PCT Pub. Date: Mar. 24, 2011

(65) Prior Publication Data

US 2012/0167810 A1 Jul. 5, 2012

(30) Foreign Application Priority Data

Sep. 17, 2009 (JP) ..... 2009-215779

(51) Int. Cl.

| | |
|---|---|
| ***D05B 21/00*** | (2006.01) |
| ***D05B 39/00*** | (2006.01) |
| ***D05C 9/04*** | (2006.01) |
| ***D05B 69/02*** | (2006.01) |
| *D05B 19/00* | (2006.01) |

(52) U.S. Cl.

CPC *D05B 39/00* (2013.01); *D05C 9/04* (2013.01); *D05B 69/02* (2013.01)

USPC ..... 112/470.18

(58) Field of Classification Search

USPC ..... 112/220, 102–103, 117–119, 470.18, 112/480.09, 475.18; 700/136–138

See application file for complete search history.

(56) References Cited

U.S. PATENT DOCUMENTS

| | | | | |
|---|---|---|---|---|
| 4,627,369 | A * | 12/1986 | Conrad et al. | 112/102.5 |
| 5,333,561 | A * | 8/1994 | Katou | 112/470.13 |
| 6,263,815 | B1 * | 7/2001 | Furudate | 112/470.13 |
| 6,293,214 | B1 * | 9/2001 | Tajima | 112/470.18 |
| 2009/0173261 | A1 * | 7/2009 | Tajima | 112/80.43 |

FOREIGN PATENT DOCUMENTS

JP 02005065959 A * 3/2005

* cited by examiner

*Primary Examiner* — Ismael Izaguirre

(74) *Attorney, Agent, or Firm* — Edwards Wildman Palmer LLP

(57) ABSTRACT

Each of front-back direction actuation blocks for actuating a sewing frame in a front-back direction has ball screws, motors, and movable members. An engagement roller of each of the movable members engages with a long side of the sewing frame, and an engagement roller of each of the movable members engages with a long side. The movable members of respective front-back direction actuation blocks are connected to short sides of the sewing frame. In each of the front-back direction actuation blocks, the ball screw and the ball screw are joined together by means of a joint member. Movable members of respective right-left direction actuation blocks support the respective front-back direction actuation blocks.

20 Claims, 17 Drawing Sheets

DRIVE DEVICE FOR SEWING MACHINE SEWING FRAME

TECHNICAL FIELD

The present invention relates to a sewing machine (an embroidery sewing machine) and, more particularly, to a sewing frame actuator of a sewing machine that actuates a sewing frame, which holds processed fabric in a stretching fashion, in both a direction X (a right-left direction) and a direction Y (a front-back direction).

BACKGROUND ART

A sewing machine; in particular, an embroidery sewing machine, has hitherto been configured so as to actuate a sewing frame, which stretches processed fabric, in both the X direction and the Y direction.

For instance, sewing frame actuators described in connection with Patent Documents 1 and 2 each include an X actuator mechanism disposed along one side of a sewing frame to actuate the sewing frame in the right-left direction and a Y actuator mechanism disposed along one side of the sewing frame to actuate the sewing frame in the front-back direction. Each of the X actuator mechanism and the Y actuator mechanism is configured so as to include one motor and a plurality of ball screws.

Patent Document 3 describes a ball screw actuator mechanism and a belt drive mechanism that actuate a long side of a sewing frame. Another long side opposite to the long side actuated by the ball screw actuator mechanism and the belt drive mechanism is provided with a slide guide mechanism. A nut of a rear ball screw actuator mechanism or a slider of a rear belt drive mechanism and a slider of a front slide guide mechanism, which are in correspondence with each other along extensions in the longitudinal direction, are joined together by means of a coupling bar.

Patent Document 4 describes a ball screw actuator mechanism that actuates a long side of a sewing frame. Another long side opposite to the long slide actuated by the ball screw actuator mechanism is provided with a side guide mechanism. A nut of a rear ball screw actuator mechanism and a slider of a front slide guide mechanism are joined together by means of a coupling bar.

RELATED ART DOCUMENTS

Patent Documents

Patent Document 1: JP-A-2005-65960
Patent Document 2: JP-A-2005-65959
Patent Document 3: JP-A-2003-336162
Patent Document 4: JP-A-2002-102571

DISCLOSURE OF THE INVENTION

Problem that the Invention is to Solve

However, in Patent Documents 1 and 2, the X actuator mechanism and the Y actuator mechanism are provided on only one of the mutually-opposed sides of the sewing frame. Hence, the sewing frame becomes distorted, which raises a problem of the inability to position the sewing frame with high accuracy.

Specifically, the sewing frame is usually formed from a material that exhibits low rigidity, like aluminum. Further, the sewing frame is also formed so as to assume a substantially C-shaped cross sectional profile. For this reason, the sewing frame itself is prone to distortion. When only one of the mutually-opposed sides of the sewing frame is equipped with the X actuator mechanism and the Y actuator mechanism, the remaining side free from the X actuator mechanism and the Y actuator mechanism is liable to distortion.

In particular, the sewing frame is usually formed into a rectangular shape, wherein long sides of the sewing frame lie in the direction X and short sides of the same lie in the direction Y. As processed fabric undergoes sewing, the fabric is pulled inwardly, which in turn pulls the sewing frame to the inside. In particular, since a sewing frame of an embroidery sewing machine exhibits high sewing density, force for pulling the sewing frame toward the interior side is correspondingly strong. Moreover, since the sewing frame assumes a rectangular shape, long sides of the sewing frame get easily distorted when the sewing frame is pulled inside.

In Patent Documents 3 and 4, among mutually-opposed long sides of a sewing frame, a long side opposite to a long side to be actuated is equipped with a slide mechanism block and also a coupling bar. However, a slider of the slide mechanism block is only actuated in a following manner by way of the coupling bar as a result of the slider in the ball screw actuator mechanism and the belt drive mechanism being actuated. Hence, depending on rigidity of the coupling bar, the coupling bar becomes distorted by tensile force developing during sewing operation, which may in turn distort the sewing frame itself.

In Patent Documents 1 and 2, each of sides of the sewing frame is equipped with one motor and a plurality of ball screws. Shafts of the respective ball screws are connected to transmission shafts by way of gears, and the transmission shafts are coupled to an output shaft of the motor. In particular, the transmission shafts laid along the long sides of the sewing frame become longer. Therefore, the transmission shafts themselves become twisted, which raises a problem of the inability to accurately synchronize actuation of the respective ball screws. In this regard, the technique described in connection with Patent Document 3 also encounters a problem. Namely, a ball screw actuator shaft extending from a Y direction actuation motor becomes distorted, thereby posing difficulty in accurately synchronizing actuation of the ball screw actuator mechanism and driving operation of the belt drive mechanism that are laid along the long side. As mentioned above, when accurate synchronization between the drive mechanism and the actuator mechanism laid along one side of the sewing frame is inaccurate, distortion occurs in the sewing frame, which makes it impossible to position the sewing frame with high accuracy.

Accordingly, a drawback to be solved by the present invention is to provide a sewing machine that prevents occurrence of distortion in a sewing frame, thereby enabling highly-accurate positioning of the sewing frame.

Means for Solving the Problem

The present invention has been conceived to solve the drawback. A first configuration of the invention is characterized by a sewing frame actuator for a sewing machine which actuates a sewing frame (50) that is a square frame for stretching processed fabric to be sewn with a sewing machine and that has a pair of long sides (52, 54) laid in parallel with each other and a pair of short sides (56, 58) laid in parallel with each other and at right angles to the respective long sides, the actuator comprising:

a sewing frame actuation block (60) for actuating the sewing frame (50) in a front-back direction and a right-left direction which includes a first front-back direction actuation block (70, 70', 140, and 140') which actuates the sewing frame in a front-back direction and second front-back direction actuation blocks (71, 71', 141, and 141') which actuate the sewing frame in a front-back direction and right-left direction actuation blocks (130, 195) which actuate the sewing frame in the right-left direction, wherein the first front-back direction actuation block includes a first movable member (87, 163) that has an engagement member (92, 168) to engage one long side of the sewing frame and that is placed so as to be movable in the front-back direction, a second movable member (107, 183) that has an engagement member (112, 188) to engage a remaining long side and that is placed so as to be movable in the front-back direction, and a first actuation block (84, 104, 158, and 178) that moves the first movable member and the second movable member in the front-back direction;

the second front-back direction actuation blocks each are laid along the pair of respective short sides of the sewing frame, and each include a third movable member (87, 163) that is connected to the short side or a longitudinal end of one long side of the sewing frame by way of a connection member (49), a fourth movable member (107, 183) that is connected to the short side or a longitudinal end of a remaining long side of the sewing frame by way of a connection member (49) and that is spaced apart from the third movable member, a second actuation block (84, 104, 158, 178) that moves the third movable member and the fourth movable member in the front-back direction, and a support (71A, 71A', 141A, and 141A') that supports the second actuation block and also supports the third movable member and the fourth movable member so as to be movable in the front-back direction; and the right-left direction actuation blocks each are laid along the pair of respective short and each include a fifth movable member (137, 195-13) that is provided so as to be movable in a right-left direction and that supports the support of the corresponding second front-back direction actuation block, and a third actuation block (134, 195-8) that actuates the fifth movable member in the right-left direction; and a control circuit (200) which synchronously controls the first actuation blocks and the second actuation blocks in such a way that the first movable members and the second movable members move in an identical direction and that the third movable members and the fourth movable members move in the same direction where the first movable member moves and also synchronously controls the third actuation blocks of right-left direction actuation blocks on one short side and the third actuation blocks of the other right-left direction actuation blocks on the remaining short side in such a way that the fifth movable members move in an identical direction.

The sewing machine of the first configuration sews (embroiders) processed fabric while actuating the fabric stretched across the sewing frame in both the front-back direction and the right-left direction. Specifically, when the first actuation block in the first front-back direction actuation block operates under control of the control circuit, the first and second movable members move. When the second actuation blocks in the respective second front-back direction actuation blocks operate under control of the control circuit, the third and fourth movable members move. When the third actuation blocks of the respective right-left direction actuation blocks operate under control of the control circuit, the fifth movable members move in the right-left direction.

The engagement members of the first and second movable members engage the long sides of the sewing frame. The third and fourth movable members are connected to the short sides of the sewing frame or longitudinal ends of long sides of the sewing frame by way of the connection members. Hence, the sewing frame moves in the front-back direction as a result of movement of the first movable member and the second movable member and movement of the third movable members and the fourth movable members. Since the fifth movable members of the right-left direction actuation blocks support the supports of the respective second front-back direction actuation blocks, the sewing frame moves in the right-left direction as a result of movement of the fifth movable members.

Therefore, the movable members support the pair of long sides of the sewing frame and the pair of short sides or the longitudinal ends of the respective long sides of the sewing frame. Hence, distortion of the sewing frame can be minimized, so that the sewing frame can be positioned with high accuracy. In particular, the third movable members and the fourth movable members of the respective second front-back direction actuation blocks are connected to the sewing frame by way of the connection members. The respective second front-back direction actuation blocks are thus actuated in the right-left direction by means of the right-left direction actuation blocks. Therefore, it is possible to prevent occurrence of deflection of the longitudinal end areas of the sewing frame, which would otherwise arise in the front-back direction.

In relation to the first configuration, a second configuration of the present invention is characterized in that the first front-back direction actuation block has first space holding means (125, 86', and 190) for maintaining constant spacing between the first movable member and the second movable member, and each of the second front-back direction actuation blocks has second space holding means (125, 86, and 190) for holding constant spacing between the third movable member and the fourth movable member.

Owing to the second configuration, the first space holding means maintains spacing between the first movable member and the second movable member. Hence, occurrence of deflection of the long sides of the sewing frame can be prevented. Moreover, the second space holding means maintains spacing between the third movable members and the fourth movable members. Hence, it is possible to prevent occurrence of deflection of the longitudinal end areas of the sewing frame in the front-back direction.

In relation to the second configuration, a third configuration of the present invention is characterized in that the first front-back direction actuation block (70, 70') has a ball screw (125, 86') for a first front-back direction actuation block as the first space holding means lying in a rotatable manner along the front-back direction; and wherein the first movable member and the second movable member are screw-engaged with the ball screw for a first front-back direction actuation block, and the first actuation block rotates the ball screw for a first front-back direction actuation block, whereby the first movable member and the second movable member move in the front-back direction. Specifically, spacing between the first movable member and the second movable member can be maintained as a result of the first movable member and the second movable member being screw-engaged with the ball screws.

In relation to the third configuration, a fourth configuration of the present invention is characterized in that, in the first front-back direction actuation block (70), the ball screw (125) for a first front-back direction actuation block has a first ball screw (86) provided in a rotatable manner along the front-back direction, a second ball screw (106) provided in a rotatable manner concentrically with the first ball screw along the front-back direction, and a joint member (124) for joining an end of the first ball screw facing the second ball screw to an end of the second ball screw facing the first ball screw; wherein the first movable member is screw-engaged with the first ball screw, and the second movable member is screw-engaged with the second ball screw; and wherein the first actuation block has a first motor (84) for rotating the first ball screw and a second motor (104) that is connected to an opposite end of the second ball screw with respect to an end thereof facing the first ball screw and that rotates the second ball screw.

Owing to the fourth configuration, when the first motor of the first front-back direction actuation block operates under control of the control circuit, the first ball screw rotates. In addition, when the second motor operates, the second ball screw rotates under control of the control circuit. The first movable member moves as the first ball screw rotates, and the second movable member moves as the second ball screw rotates. The engagement member of the first movable member and the engagement member of the second movable member engage the long sides of the sewing frame. Hence, the sewing frame moves in the front-back direction as a result of movement of the first movable member and the second movable member. As mentioned above, the long sides of the sewing frame are actively positioned by means of the first motor and the second motor. Thereby, even when processed fabric is pulled inside by tensile force developing during sewing operation, occurrence of distortion of the sewing frame can be prevented. Moreover, since the ball screw generally exhibit high rigidity, there is a little possibility that shaft-shaped member made up of the first ball screw, the second ball screw, and the joint member will become deformed despite tensile force developing during sewing operation.

In particular, in the first front-back direction actuation block that supports the long side of the sewing frame, the first ball screw and the second ball screw are integrally formed by way of the joint member. Hence, even if movable members attempt to move against the force of the motors as a result of the sewing frame becoming deformed (in particular toward the inside), the movable members will not move against the force of the motors because the ball screws with which the respective movable members are screw-engaged are formed integrally with the other corresponding ball screws. Therefore, occurrence of distortion of the long sides of the sewing frame can be prevented.

In the fourth configuration, both ends of the first ball screw is axially supported by first bracket (82, 282), and portions of the first ball screw facing the second ball screw is formed so as to protrude from the first bracket. Further, both ends of the second ball screw is axially supported by second bracket (102, 302), and portions of the second ball screw facing the first ball screw is formed so as to protrude from the second bracket.

In relation to any one of the second through fourth configurations, a fifth configuration of the present invention is characterized in that the support (71A, 71A') of each of the second front-back direction actuation blocks (71, 71') has a ball screw (125, 86) for a second front-back direction actuation block lying as the second space holding means in a rotatable manner along the front-back direction; and wherein the third movable member and the fourth movable member are screw-engaged with the ball screw for a second front-back direction actuation block, and the second actuation block rotates the ball screw for a second front-back direction actuation block, whereby the third movable member and the fourth movable member move in the front-back direction. Namely, spacing between the third movable members and the fourth movable member can be maintained by means of the third movable members and the fourth movable members being screw-engaged with the respective ball screws.

In relation to the fifth configuration, a sixth configuration of the present invention is characterized in that, in each of the second front-back direction actuation blocks (71), the ball screw (125) for a second front-back direction actuation block has a third ball screw (86) provided in a rotatable manner along the front-back direction, a fourth screw (106) provided concentrically with the third ball screw in a rotatable manner along the front-back direction; and a joint member (124) for joining an end of the third ball screw facing the fourth ball screw to an end of the fourth ball screw facing the third ball screw; wherein the third movable member is screw-engaged with the third ball screw, and the fourth movable member is screw-engaged with the fourth ball screw; and wherein the second actuation block has a third motor (84) for rotating the third ball screw and a fourth motor (104) that is connected to an opposite end of the fourth ball screw with respect to an end thereof facing the third ball screw and that rotates the fourth ball screw.

Owing to the sixth configuration, when the third motors of the respective second front-back direction actuation blocks operate under control of the control circuit, the third ball screws rotate. In addition, when the respective fourth motors operate under control of the control circuit, the fourth ball screws rotate. The third movable members move as the third ball screws rotate, and the fourth movable members move as the fourth ball screws rotate. Since the third movable members and the fourth movable members are connected to the respective short sides of the sewing frame or longitudinal ends of the respective long sides of the sewing frame. Hence, the sewing frame moves in the front-back direction as a result of movement of the third and fourth movable members. As above, predetermined positions on the short sides of the sewing frame or positions of the longitudinal ends of the long sides of the sewing frame are actively set. As a result, even if processed fabric is pulled inside by tensile force developing during sewing operation, occurrence of distortion of the sewing frame can be prevented. Since the ball screws generally exhibit high rigidity, there is a little possibility that shaft-shaped members made up of the third ball screws, the fourth ball screws, and the joint members will become deformed despite tensile force developing during sewing operation.

In particular, in the second front-back direction actuation blocks that support the short sides of the sewing frame, the third ball screws and the fourth ball screws are integrally formed by way of the joint members. Hence, even if movable members attempt to move against the force of the motors as a result of the sewing frame becoming deformed (in particular toward the inside), the movable members will not move against the force of the motors because the ball screws with which the respective movable members are screw-engaged are formed integrally with the other corresponding ball screws. Therefore, occurrence of distortion of the longitudinal end areas of the sewing frame in the front-back direction can be prevented.

In relation to any one of the first through sixth configurations, a seventh configuration of the present invention is characterized in that the fifth movable member of each of the right-left direction actuation blocks (130, 195) is moved by means of a ball screw mechanism or a timing belt mechanism that is actuated by the third actuation block. Therefore, as a result of the short sides of the sewing frame being actively positioned, it is possible to prevent occurrence of distortion of the sewing frame even when processed fabric is pulled inside by means of tensile force developing during sewing operation.

In relation to any one of the first through seventh configurations, an eighth configuration of the present invention is characterized in that the respective right-left direction actuation blocks (130) are provided in correspondence with one short side and a remaining short side; wherein each of first right-left direction actuation blocks provided in correspondence with one short side has a fifth ball screw (136) provided in a rotatable manner along the right-left direction; wherein each of the fifth ball screws is rotated by a fifth motor (134) that is provided in each of the first right-left direction actuation blocks and that serves as the third actuation block; and the fifth movable member provided in each of the first right-left direction actuation blocks is screw-engaged with the fifth ball screw and moves in the right-left direction as a result of rotation of the fifth ball screw; and each of second right-left direction actuation blocks provided in correspondence with a remaining short side includes a sixth ball screw (136) provided in a rotatable manner along the right-left direction; the sixth ball screw is rotated by a sixth motor (134) that is provided in each of the second right-left direction actuation blocks and that serves as the third actuation block; the fifth movable member provided in each of the second right-left direction actuation blocks is screw-engaged with the sixth ball screw and moves in the right-left direction as a result of rotation of the sixth ball screw.

In relation to the second configuration, a ninth configuration of the present invention is characterized in that the first front-back direction actuation block (140) has a first timing belt (162) provided so as to be revolvable in the front-back direction and a second timing belt (182) that is provided so as to be revolvable in the front-back direction and that has a path of revolution in an extension of a path of revolution of the first timing belt; the first movable member is fixed to the corresponding first timing belt; the second movable member is fixed to the corresponding second timing belt; a rod-shaped joint member (190) serving as the first space holding means is interposed between the first movable member and the second movable member; and the first actuation block has a first motor for revolving the first timing belt and a second motor for revolving the second timing belt.

Owing to the ninth configuration, when the first motor of the first front-back direction actuation block operates under control of the control circuit, the first timing belt revolves. When the second motor operates under control of the control circuit, the second timing belt revolves. The first movable member moves as the first timing belt revolves, and the second movable member moves as the second timing belt revolves. Since the engagement member of the first movable member and the engagement member of the second movable member engage the respective long sides of the sewing frame, the sewing frame moves in the front-back direction as a result of movement of the first and second movable members. As above, the first movable member is secured to the first timing belt, and the second movable member is secured to the second timing belt. Moreover, the rod-like joint member serving as the first space holding means is interposed between the first and second movable members. Hence, spacing between the first movable member and the second movable member can be maintained. Therefore, the first motor and the second motor actively position the long sides of the sewing frame. Even if processed fabric is pulled inside by tensile force developing during sewing operation, occurrence of distortion of the sewing frame can be prevented. In particular, in the first front-back direction actuation block that supports the long side of the sewing frame, the first movable member and the second movable member are integrally formed by way of each of the joint member. Hence, even if the movable members attempt to move against the force of the motors as a result of the sewing frame becoming deformed (in particular toward the inside), movement of the movable members will be restricted by the joint member, so that the movable members will not move against the force of the motors. Specifically, if processed fabric to be sewn is pulled inside as the fabric is sewn, the long sides of the sewing frame will also be pulled inside. Both the first and second movable members are thus pulled inside. However, since both the first and second movable members are secured to the respective joint members, the movable members will not move inside. Consequently, a possibility of deformation of the sewing frame; in particular, a possibility of deformation of the long sides, can be minimized, and the sewing frame can be positioned with high accuracy.

In relation to the second configuration, a tenth configuration of the present invention is characterized in that the first front-back direction actuation block (140') has a timing belt (162) for a first front-back direction actuation block provided so as to be revolvable in the front-back direction; the first movable member and the second movable member are secured to the timing belt for a first front-back direction actuation block; and a rod-shaped joint member (190) serving as the first space holding means is interposed between the first movable member and the second movable member; and the first actuation block revolves the timing belt for a first front-back direction actuation block.

Owing to the tenth configuration, when the first actuation block of the first front-back direction actuation block operates under control of the control circuit, the timing belt for a first front-back direction actuation block revolve, whereupon the first movable member and the second movable member move. Since the engagement member of the first movable member and the engagement members of the second movable member engage the respective long sides of the sewing frame, the sewing frame moves in the front-back direction as a result of movement of the first and second movable members. As above, the first movable member and the second movable member are secured to the timing belt for a first front-back direction actuation block. Moreover, the rod-like joint members serving as the first space holding means are interposed between the first and second movable member. Hence, spacing between the first movable member and the second movable member can be maintained. Therefore, the first actuation block actively position the long sides of the sewing frame. Even if processed fabric is pulled inside by tensile force developing during sewing operation, occurrence of distortion of the sewing frame can be prevented. In particular, in the first front-back direction actuation block that supports the long sides of the sewing frame, the first movable member and the second movable member are integrally formed by way of the joint member. Hence, even if the movable member attempt to move against the force of the first actuation block as a result of the sewing frame becoming deformed (in particular toward the inside), movement of the movable members will be restricted by the joint member, so that the movable members will not move against the force of the first actuation block. Specifically, if processed fabric to be sewn is pulled inside as the fabric is sewn, the long sides of the sewing frame will also be pulled inside. Both the first and second movable members are thus pulled inside. However, since both the first and second movable members are secured to the joint member, the movable members will not move inside. Consequently, a possibility of deformation of the sewing frame; in particular, a possibility of deformation of the long sides, can be minimized, and the sewing frame can be positioned with high accuracy.

In relation to the second, ninth, or tenth configuration, an eleventh configuration of the present invention is characterized in that the support (141A) of each of the second front-back direction actuation blocks (141) has a third timing belt (162) provided so as to be revolvable in the front-back direction and a fourth timing belt (182) that is provided so as to be revolvable in the front-back direction and that has a path of revolution in an extension of a path of revolution of the third timing belt; the third movable member is secured to the third timing belt; the fourth movable member is secured to the fourth timing belt; a rod-shaped joint member (190) to serve as second space holding means is interposed between the third movable member and the fourth movable member; and each of the second actuation blocks includes a third motor for revolving the third timing belt and a fourth motor for revolving the fourth timing belt.

Owing to the eleventh configuration, when the third motors of the second front-back direction actuation blocks operate under control of the control circuit, the third timing belts revolve. When the fourth motors operate under control of the control circuit, the fourth timing belts revolve. The third movable members move as the third timing belts revolve, and the fourth movable members move as the fourth timing belts revolve. Since the respective third movable members and the respective fourth movable members engage the respective short sides of the sewing frame or longitudinal ends of the respective long sides of the sewing frame, the sewing frame moves in the front-back direction as a result of movement of the third and fourth movable members. As above, the third movable members are secured to the third timing belts, and the fourth movable members are secured to the fourth timing belts. Moreover, the rod-like joint members serving as the second space holding means are interposed between the respective third and fourth movable members. Hence, spacing between the third movable members and the fourth movable members can be maintained. As mentioned above, the predetermined positions on the short sides of the sewing frame or the positions of the longitudinal ends of the long sides of the sewing frame are actively positioned. As a result, even if processed fabric is pulled inside by means of tensile force developing during sewing operation, occurrence of distortion of the sewing frame can be prevented. In particular, in the second front-back direction actuation blocks that are provided along the respective short sides of the sewing frame, the third movable members and the fourth movable members are integrally formed by way of the joint members. Hence, even if the movable members attempt to move against the force of the motors as a result of the sewing frame becoming deformed (in particular toward the inside), movement of the movable members will be restricted by the joint members, so that the movable members will not move against the force of the motors. Specifically, if processed fabric to be sewn is pulled inside as the fabric is sewn, the long sides of the sewing frame will also be pulled inside. Both the third and fourth movable members are thus pulled inside. However, since both the third and fourth movable members are secured to the respective joint members, the movable members will not move inside. Consequently, a possibility of deformation of the sewing frame; in particular, a possibility of deformation of the long sides, can be minimized, thereby preventing occurrence of distortion in the longitudinal end areas of the sewing frame in the front-back direction.

In relation to the second, ninth, or tenth configuration, a twelfth configuration of the present invention is characterized in that the support (141A') of each of the second front-back direction actuation blocks (141') has a timing belt for a second front-back direction actuation block provided so as to be revolvable in the front-back direction; the third movable member and the fourth movable member are secured to the timing belt for a second front-back direction actuation block; a rod-shaped joint member to serve as the second space holding means is interposed between the third movable member and the fourth movable member; and each of the second actuation blocks revolves the timing belt for a second front-back direction actuation block.

Owing to the twelfth configuration, when the second actuation blocks of the second front-back direction actuation blocks operate under control of the control circuit, the timing belts for a second front-back direction actuation block revolve. The third movable members and the fourth movable members thereupon move. Since the respective third movable members and the respective fourth movable members are connected to the respective short sides of the sewing frame or longitudinal ends of the respective long sides of the sewing frame, the sewing frame moves in the front-back direction as a result of movement of the third and fourth movable members. As above, the third movable members and the fourth movable members are secured to the timing belts for a second front-back direction actuation block. Moreover, the rod-like joint members serving as the second space holding means are interposed between the respective third and fourth movable members. Hence, spacing between the third movable members and the fourth movable members can be maintained. As mentioned above, the predetermined positions on the short sides of the sewing frame or the positions of the longitudinal ends of the long sides of the sewing frame are actively positioned. As a result, even if processed fabric is pulled inside by means of tensile force developing during sewing operation, occurrence of distortion of the sewing frame can be prevented. In particular, in the second front-back direction actuation blocks that are provide along the respective short sides of the sewing frame, the third movable members and the fourth movable members are integrally formed by way of the joint members. Hence, even if the movable members attempt to move against the force of the motors as a result of the sewing frame becoming deformed (in particular toward the inside), movement of the movable members will be restricted by the joint members, so that the movable members will not move against the force of the motors. Specifically, if processed fabric to be sewn is pulled inside as the fabric is sewn, the long sides of the sewing frame will also be pulled inside. Both the third and fourth movable members are thus pulled inside. However, since both the third and fourth movable members are secured to the respective joint members, the movable members will not move inside. Consequently, a possibility of deformation of the sewing frame; in particular, a possibility of deformation of the long sides, can be minimized, thereby preventing occurrence of distortion in the longitudinal end areas of the sewing frame in the front-back direction.

In relation to any of the ninth to twelfth configurations, a thirteenth configuration of the present invention is characterized in that each of the fifth movable members of the respective right-left direction actuation blocks (130, 195) is moved by means of a ball screw mechanism or a timing belt mechanism that is actuated by the third actuation block. Consequently, the short sides of the sewing frame are actively positioned. Therefore, even if processed fabric is pulled inside by means of tensile force developing during sewing operation, occurrence of distortion of the sewing frame can be prevented.

In relation to the first, second, ninth, tenth, eleventh, twelfth, or thirteenth configuration, a fourteenth configuration of the present invention is characterized in that the respective right-left direction actuation blocks (195) are provided in correspondence with one short side and a remaining short side; each of first right-left direction actuation blocks provided in correspondence with one short side has a fifth timing belt (195-12) provided so as to be revolvable in the right-left direction; the fifth timing belt is rotated by a fifth motor (195-8) that is provided in the corresponding right-left direction actuation block and that serves as the third actuation block; each of the fifth movable members provided in the respective first right-left direction actuation blocks is fastened to the fifth timing belt and moves in the right-left direction as a result of revolution of the fifth timing belt; and each of second right-left direction actuation blocks provided in correspondence with a remaining short side has a sixth timing belt (195-12) provided so as to be revolvable in the right-left direction; the sixth timing belt is rotated by a sixth motor (195-8) that is provided in the corresponding second right-left direction actuation block and that serves as the third actuation block; and each of the fifth movable member provided in the respective second right-left direction actuation blocks is fastened to the sixth timing belt and moves in the right-left direction as a result of revolution of the sixth timing belt.

The following can also be adopted as a fifteenth configuration of the present invention. The fifteenth configuration of the invention is characterized by a sewing frame actuator for a sewing machine that actuates a sewing frame (50) which is a square frame for stretching processed fabric to be sewn with a sewing machine and which has a pair of long sides (52, 54) laid in parallel with each other and a pair of short sides (56, 58) laid in parallel with each other and at right angles to the respective long sides, the actuator comprising:

a sewing frame actuation block (60) for actuating the sewing frame (50) in a front-back direction and a right-left direction which includes a first front-back direction actuation block (70) which actuates the sewing frame in the front-back direction and second front-back direction actuation blocks (71) which actuate the sewing frame in the front-back direction and right-left direction actuation blocks (130) which actuate the sewing frame in the right-left direction, wherein the first front-back direction actuation block (70) includes:

a first ball screw (86) provided so as to be rotatable in the front-back direction, a first motor (84) that is connected to an end of the first ball screw opposing a second ball screw and that rotates the first ball screw, a first movable member (87) that is screw-engaged with the first ball screw and moves in the front-back direction as a result of rotation of the first ball screw and that has an engagement member (92) to engage one of long sides of the sewing frame, a second ball screw (106) that is provided in a rotatable manner in the front-back direction, a second motor (104) that is connected to an end of the second ball screw opposing the first ball screw and that rotates the second ball screw, a second movable member (107) that is screw-engaged with the second ball screw and that moves in the front-back direction as a result of rotation of the second ball screw and that has an engagement member (112) to engage a remaining long side, and a joint member (124) that connects an end of the first ball screw facing the second ball screw to an end of the second ball screw facing the first ball screw;

the second front-back direction actuation blocks (71) each are laid along the respective short sides of the sewing frame, and each include a third ball screw (86) provided so as to be rotatable in the front-back direction, a third motor (84) that is connected to an end of the third ball screw opposing a fourth ball screw and that rotates the third ball screw, a third movable member (87) that is screw-engaged with the third ball screw, that moves in the front-back direction as a result of rotation of the third ball screw, and that is connected to the short side of the sewing frame or a longitudinal end of a long side of the sewing frame by way of a connection member (49), a fourth ball screw (106) that is provided so as to be rotatable in the front-back direction and that is placed concentrically with the third ball screw, a fourth motor (104) that is connected to an end of the fourth ball screw opposing the third ball screw and that rotates the fourth ball screw, a fourth movable member (107) that is screw-engaged with the fourth ball screw, that moves in the front-back direction as a result of rotation of the fourth ball screw, and that is connected to the short side of the sewing frame or a longitudinal end of a long side of the sewing frame by way of a connection member (49), a joint member (124) that connects an end of the third ball screw facing the fourth ball screw to an end of the fourth ball screw facing the third ball screw and a support (72) that supports the third ball screw, the third motor, the fourth ball screw, and the fourth motor;

the right-left direction actuation blocks (130) each are laid in correspondence with the pair of respective short sides and each include a fifth movable member (137) that is provided so as to be movable in the right-left direction and that supports the support (72) of the corresponding second front-back direction actuation block (71), and a fifth motor (134) that moves the fifth movable member in the right-left direction, wherein the fifth movable member is moved by means of a ball screw mechanism or a timing belt mechanism actuated by the fifth motor; and a control circuit (200) for controlling operation of the respective motors that synchronously controls the first motor, the second motor, the third motor, and the fourth motor in such a way that the first ball screws and the second ball screws rotate in an identical direction, that the first movable members and the second movable members move in an identical direction, that the third ball screws and the fourth ball screws rotate in the same direction where the first ball screw rotates, and that the third movable members and the fourth movable members move in the same direction where the first movable member moves and also synchronously controls the fifth motors of the right-left direction actuation blocks on one short side and the fifth motors of the right-left direction actuation blocks on the other short side such that the fifth movable members move in a same direction.

The following can also be adopted as a sixteenth configuration of the present invention. The sixteenth configuration of the invention is characterized by a sewing frame actuator for a sewing machine which actuates a sewing frame (50) that is a square frame for stretching processed fabric to be sewn with a sewing machine and that has a pair of long sides (52, 54) laid in parallel with each other and a pair of short sides (56, 58) laid in parallel with each other and at right angles to the respective long sides, the actuator comprising:

a sewing frame actuation block (60) that actuates the sewing frame in a front-back direction and a right-left direction which includes a first front-back direction actuation block (140) which actuates the sewing frame in the front-back direction and second front-back direction actuation blocks (141) which actuate the sewing frame in the front-back direction and right-left direction actuation blocks (195) which actuate the sewing frame in the right-left direction, wherein the first front-back direction actuation block (140) includes a first timing belt (162) provided so as to be revolvable in the front-back direction, a first motor (158) that rotates the first timing belt, a first movable member (163) that is secured to the first timing belt, that moves in the front-back direction as a result of revolution of the first timing belt, and that has an engagement member to engage one of long sides of the sewing frame, a second timing belt (182) that is provided so as to be revolvable in the front-back direction and that has a path of revolution in an extension of a path of revolution of the first timing belt, a second motor (178) that rotates the second timing belt, a second movable member (183) that is secured to the second timing belt and that moves in the front-back direction as a result of revolution of the second timing belt and that has an engagement member to engage a remaining one of long sides of the sewing frame, and a rod-shaped joint member (190) interposed between the first movable member and the second movable member;

the second front-back direction actuation blocks (141) each include a third timing belt (162) provided so as to be revolvable in the front-back direction, a third motor (158) that rotates the third timing belt, a third movable member (163) that is secured to the third timing belt, that moves in the front-back direction as a result of revolution of the third timing belt, and that is connected to the short side of the sewing frame or a longitudinal end of the long side of the sewing frame by way of a connection member (49), a fourth timing belt (182) that is provided so as to be revolvable in the front-back direction and that has a path of revolution in an extension of a path of revolution of the third timing belt, a fourth motor (178) that rotates the fourth timing belt, a fourth movable member (183) that is secured to the fourth timing belt, that moves in the front-back direction as a result of revolution of the fourth timing belt, and that is connected to the short side of the sewing frame or a longitudinal end of the long side of the sewing frame by way of a connection member (49), a rod-shaped joint member (190) interposed between the third movable member and the fourth movable member, and a support (151, 154, 156, 160, 174, 176, 180) that support the third motor and the fourth motor and also support the third timing belt and the fourth timing belt so as to be revolvable;

the right-left direction actuation blocks (195) each are laid along the pair of respective short sides, and each include a fifth movable member (195-13) that is provided so as to be movable in the right-left direction and that supports the supports (151, 154, 156, 160, 174, 176, 180) of the corresponding second front-back direction actuation block (141), and a fifth motor (195-8) that moves the fifth movable member in the right-left direction, wherein the fifth movable member is moved by means of a ball screw mechanism or a timing belt mechanism actuated by the fifth motor; and a control circuit (200) for controlling operation of the respective motors that synchronously controls the first motor, the second motor, the third motor, and the fourth motor in such a way that the first timing belts and the second timing belts revolve in a same direction, that the first movable member and the second movable member move in an identical direction, that the third timing belt and the fourth timing belt revolve in a direction identical to a direction of revolution of the first timing belt, and that the third movable members and the fourth movable members move in the same direction where the first movable member moves and also synchronously controls the fifth motors of the right-left direction actuation blocks on one short side and the fifth motors of the right-left direction actuation blocks on the other short side such that the fifth movable members move in an identical direction.

Advantage of the Invention

In the sewing frame actuator for a sewing machine of the present invention, the movable members support the pair of long sides of the sewing frame and the pair of short sides or the longitudinal ends of the respective long sides of the sewing frame. Hence, distortion of the sewing frame can be minimized, so that the sewing frame can be positioned with high accuracy. In particular, the third movable members and the fourth movable members of the respective second front-back direction actuation blocks are connected to the sewing frame by way of the connection members. The respective second front-back direction actuation blocks are thus actuated in the right-left direction by means of the right-left direction actuation blocks. Therefore, it is possible to prevent occurrence of deflection of the longitudinal end areas of the sewing frame, which would otherwise arise in the front-back direction. Furthermore, when the first space holding means and the second space holding means are provided, the first space holding means maintains spacing between the first movable members and the second movable members. Hence, occurrence of deflection of the long sides of the sewing frame can be prevented. Moreover, the second space holding means maintains spacing between the third movable members and the fourth movable members. Hence, it is possible to prevent occurrence of deflection of the longitudinal end areas of the sewing frame in the front-back direction.

EMBODIMENTS FOR IMPLEMENTING THE INVENTION

Figure 1:
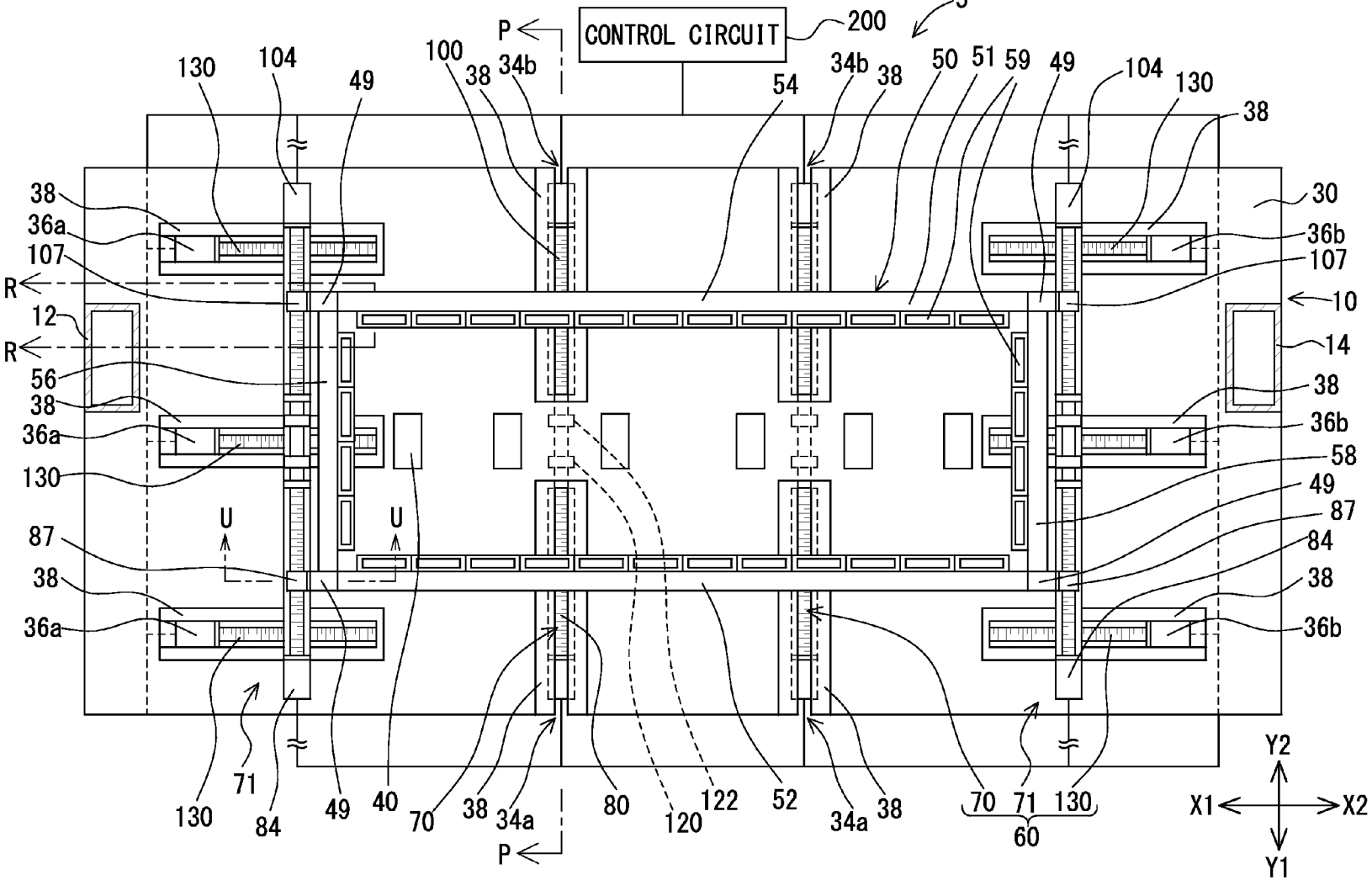
FIG. 1 It is a plan view of a principal block of a sewing machine of an embodiment of the present invention.
Figure 2:
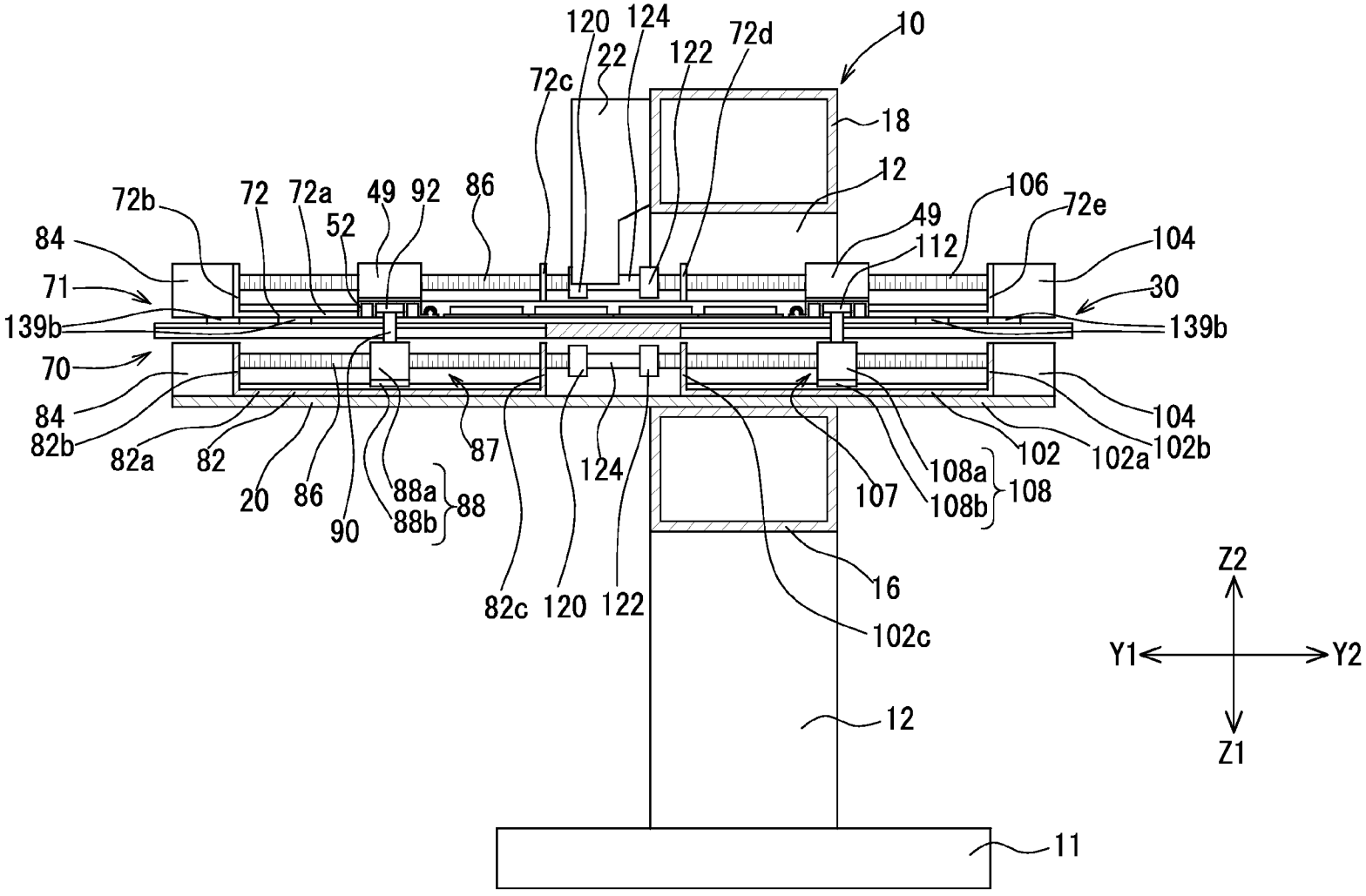
FIG. 2 It is a cross sectional view taken along line P-P shown in FIG. 1.

The present invention accomplishes an objective for providing a sewing machine that can position a sewing frame with a high degree of accuracy by preventing occurrence of distortion in the sewing frame; in particular, an objective for providing a sewing machine that can position a sewing frame with high accuracy by preventing occurrence of distortion in long sides of the sewing frame.

An embroidery sewing machine of a sewing machine 5 of an embodiment of the present invention is built as shown in FIGS. 1 through 10. Namely, the sewing machine has a frame block 10, a table 30, a sewing frame 50, a sewing frame actuation block 60, and a control circuit 200. In the drawings, direction Y1-Y2 is orthogonal to direction X1-X2, and X1-X2 direction and Y1-Y2 direction are orthogonal to Z1-Z2 direction. The sewing frame actuation block 60 and the control circuit 200 make up a sewing frame actuator for a sewing machine.

The frame block 10 makes up a machine casing of the sewing machine 5. The frame block 10 has bases 11 that are formed along the front-back direction (the direction Y1-Y2) and that are disposed on both sides of the right-left direction (the X1-X2 direction); vertical frame blocks 12 and 14 that stand on the respective bases 11, to thus serve as pillars; horizontal frame blocks 16 and 18 that are horizontally laid between the pair consisting of the vertical frame blocks 12 and 14; and beds 20. The horizontal frame block 16 is horizontally laid at an arbitrary position along a heightwise direction of the pair consisting of the vertical frame blocks 12 and 14, and both sides of the horizontal frame block 16 are secured to the vertical frame block 12 and the vertical frame block 14. The horizontal frame block 18 is horizontally laid at a position higher than the horizontal frame block 16 and parallel to the horizontal frame block 16, and both sides of the horizontal frame block 18 are secured to the vertical frame block 12 and the vertical frame block 14. Each of the beds 20 assumes the shape of a plate and is horizontally supported by an upper surface of the horizontal frame block 16. The beds 20 are provided for installing front-back direction actuation blocks 70 and right-left direction actuation blocks 130. Hence, the beds 20 are disposed at a position beneath the front-back direction actuation blocks 70 and the right-left direction actuation blocks 130. For instance, plate-like members each of which has a width enabling installation of the corresponding front-back direction actuation block 70 are laid in correspondence with the respective front-back direction actuation blocks 70 along the front-back direction. Moreover, in relation to the right-left direction actuation blocks 130, three right-left direction actuation blocks 130 are put on an upper surface of one of the beds 20. The beds 20 are not placed in an area of openings 40 when viewed in a plane.

A sewing head 22 (or an embroidery head can also be used) having a well known structure is placed on a front side of the horizontal frame block 18. The sewing head 22 has a needle bar case (not shown) that supports a plurality of needle bars (a sewing needle is secured to each of the needle bars) so as to be vertically movable; thread take-up levers (not shown) each of which repeat operation for pulling up a needle thread inserted into the sewing needle and returning the needle thread to its original position, to thus perform swaying operation; and presser feet (not shown) that are attached to a lower end of the sewing head 22 to press processed fabric during performance of sewing operation. The presser feet are also vertically actuated in synchronism with vertical movement of the needle bars. The sewing needles, the thread take-up levers, and the presser feet perform sewing (in particular embroidery sewing) of the processed fabric by means of cooperated operation with corresponding shuttles to be rotationally actuated (not shown). The shuttles are disposed below the table 30 and supported on the respective beds 20.

The table 30 assumes a shape of a substantially rectangular plate and is horizontally interposed between the pair consisting of the vertical frame blocks 12 and 14. Specifically, a plurality of frame members (not shown) each of which assumes a substantially C-shaped cross sectional profile are laid, on an upper surface of the horizontal frame block 16, at predetermined intervals along the front-back direction. The table 30 is put on upper surfaces of the respective frame members and above the beds 20. The table 30 is thus disposed while vertically spaced apart from the beds 20 by a predetermined interval. Cutouts 32 are formed in respective lateral sides of the table 30 to set the respective vertical frame blocks 12 and 14. The beds 20 and the frame members are put, on the upper surface of the horizontal frame block 16, but in different areas thereof.

Slit-like cutouts 34*a* and 34*b* are formed in the table 30 in such a way that a projecting member (specifically the shaft portion 90, 110) of a ball screw mechanism block 80, 100, which make up the sewing frame actuation block 60, are inserted into the table 30 and become movable in the horizontal direction (the Y1-Y2 direction). Further, slit-like openings 36*a* and 36*b* are formed in the table 30 in such a way that projecting members (specifically support members 139) of the right-left direction actuation blocks 130 are inserted into the table and become movable in the horizontal direction (the direction X1-X2). Specifically, the plurality of slit-like cutouts 34*a* and 34*b* are formed in alignment with front-back direction and from a pair of respective long sides of the table toward the inside of the table along the direction Y1-Y2. The cutouts 34*a* formed in a frontal long side of the table and the cutouts 34*b* formed in a dorsal long side of the same are situated opposite each other (i.e., at the same positions in the right-left direction). The cutouts 34*b* are formed on respective extensions of the cutouts 34*a*. Each of cutout pairs is formed from the mutually-opposed cutouts 34*a* and 34*b*. As will be described later, the sewing frame actuation block 60 of the embodiment is provided with the two front-back direction actuation blocks 70. The two slit-like cutouts 34*a* are formed on one long side of the table 30 along the Y1-Y2 direction, whilst the two slit-like cutouts 34*b* are formed on the other long side of the same along the Y1-Y2 direction. The cutouts 34*a* and the cutouts 34*b* are formed at mutually-opposed positions (the same positions in the right-left direction). A distance between the two cutouts 34*a* is determined in such a way that a substantially equal distance exists among four adjacent front-back direction actuation blocks 70 and 71. Specifically, the distance between the two cutouts 34*a* is set in such a way that a distance between the left front-back direction actuation block 71 in FIG. 1 and the left front-back direction actuation block 70 of the two front-back direction actuation blocks 70, a distance between the two front-back direction actuation blocks 70, and a distance between the right front-back direction actuation block 71 shown in FIG. 1 and the right front-back direction actuation block 70 of the two front-back direction actuation blocks 70 substantially become equal to each other.

The slit-like openings 36*a* and 36*b* are formed in right and left ends of the table 30 along the right-left direction; namely, the openings 36*a* are formed in a left area of the table, and the openings 36*b* are formed in a right area of the same. The openings 36*a* are formed in the outside (the left side) of the leftmost cutouts 34*a* and 34*b* of the plurality of cutouts 34*a* and 34*b*. Further, the openings 36*b* are formed in the outside (the right side) of the rightmost cutouts 34*a* and 34*b* of the plurality of cutouts 34*a* and 34*b*. The openings 36*a* and the openings 36*b* are formed in mutually-opposed positions (i.e., at the same positions in the front-back direction). The openings 36*b* are formed on extensions of the respective openings 36*a*. The openings 36*a* and 36*b* opposing each other make up a pair of openings. As will be described later, the sewing frame actuation block 60 of the present embodiment is provided with the three right-left direction actuation blocks 130. To this end, the three slit-like openings 36*a* are formed in one end area along a short side (a left-side area) of the table 30, whereas the three slit-like openings 36*b* are formed in the other end area along the other short side (a right-side area) of the table 30. The openings 36*a* are formed in the outside (left side) of the leftmost cutouts 34*a* and 34*b* of the plurality of cutouts 34*a* and 34*b*, whilst the openings 36*b* are formed in the outside (right side) of the rightmost cutouts 34*a* and 34*b* of the plurality of cutouts 34*a* and 34*b*. The openings 36*a* and 36*b* are formed in mutually-opposed positions (i.e., the same positions in the front-back direction), and the openings 36*b* are formed on extensions of the respective openings 36*a*. The opening 36*a* and the corresponding opening 36*b* make up a pair of openings. The center opening 36*a* of the three openings 36*a* is placed at a substantially intermediate position between the cutout 34*a* and the cutout 34*b* with respect to the front-back direction. The remaining two openings 36*a* are substantially equidistant from the center opening 36*a*. Likewise, the center opening 36*b* of the three openings 36*b* is placed at a substantially intermediate position between the cutouts 34*a* and the cutouts 34*b* with respect to the front-back direction. The remaining two openings 36*b* are located at substantially equidistant from the center opening 36*b*.

A direction along which the cutouts 34*a* and 34*b* are aligned and a direction along which the openings 36*a* and 36*b* are aligned form a right angle. The cutouts 34*a* and the cutouts 34*b* are formed so as to assume the same width, and the openings 36*a* and the openings 36*b* are formed so as to assume the same width.

Surroundings of the respective cutouts 34*a* and 34*b* and surroundings of the respective openings 36*a* and 36*b* in the upper surface of the table 30 are formed as recesses that recede from the upper surface of the table 30. Slit plates 38 each of which is a plate-like member having a slit are provided in the respective recesses. Each of the slit plates 38 is a plate-like member having a substantially C-shaped geometry when viewed in plane. Upper surfaces of the respective slit plates are flush with the upper surface of the table 30. The slits of the slit plates 38 fitted into the respective cutouts 34*a* and 34*b* are formed so as to become smaller in width than the cutouts 34*a* and 34*b* and the openings 36*a* and 36*b*. The slits of the slit plates 38 fitted into the respective openings 36*a* and 36*b* are formed so as to become equal to or smaller in width than the openings 36*a* and 36*b* (or narrower than the openings 36*a* and 36*b*) and greater in width than the slits of the slit plates 38 to be fitted into the cutouts 34*a* and 34*b*. Specifically, the shaft portions 90 and 110 protrude from the slits of the respective slit plates 38 fitted into the cutouts 34*a* and 34*b*, whereas the pair of support members 139 protrude from the slits of the respective slit plates 38 fitted into the openings 36*a* and 36*b*. Accordingly, the slits of the slit plates 38 of the openings 36*a* and 36*b* are formed so as to become larger in width than the slits of the slit plates 38 of the cutouts 34*a* and 34*b*. The openings 36*a* and 36*b* are consequently formed so as to become greater in width than the cutouts 34*a* and 34*b*.

Moreover, the openings 40 are formed, at a predetermined interval along the right-left direction, in a substantially center area of the table 30 in its front-back direction. The shuttles (not shown) are situated at locations of the respective openings 40, and sewing needles (not shown) are situated at elevated positions above the respective openings 40.

The sewing frame 50 (which may also be embodied as a fabric holding frame, a movable frame, or an embroidery frame) is a frame member for holding processed fabric in a stretched fashion. The sewing frame is placed at an elevated location above the table 30. The sewing frame 50 has a sewing frame body 51 and a clip 59.

Figure 8:
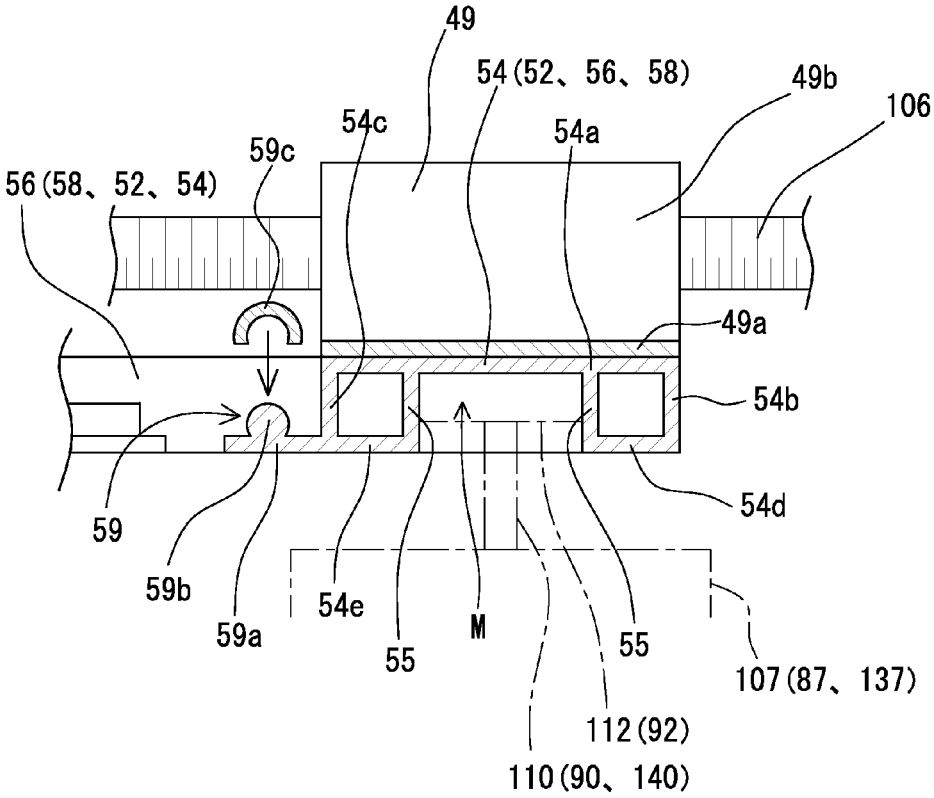
FIG. 8 It is a cross sectional view of a sewing frame that is a cross sectional elevation taken along line R-R shown in FIG. 1.

The sewing frame body 51 assumes a shape of a rectangular frame when viewed in plane and has a frontal long side 52, a dorsal long side 54, a left short side 56, and a right short side 58. Each of the long sides 52 and 54 and the short sides 56 and 58 assumes an elongated strip shape when viewed in plane, as well as assuming a shape of a substantially C-shaped frame as a transverse cross sectional profile. Specifically, as shown in FIG. 8, the long side 54 has a horizontal plate portion 54*a*; vertical plate portions 54*b* and 54*c* continually extending from respective long sides of the plate portion 54*a* (the plate portions 54*b* and 54*c* are parallel to each other); a pair of plate portions 55 formed so as to extend downwardly from a lower surface of the plate portion 54*a* between the plate portion 54*b* and the plate portion 54*c*; a plate portion 54*d* interposed between a lower end of the plate portion 54*b* and a lower end of the plate portion 55 adjacent to the plate portion 54*b* (the plate portion 54*d* is parallel to the plate portion 54*a* and seals a space between the plate portion 54*b* and the plate portion 55); and a plate portion 54*e* interposed between a lower end of the plate portion 54*c* and a lower end of the plate portion 55 adjacent to the plate portion 54*c* (the plate portion 54*e* is parallel to the plate portion 54*a* and seals a space between the plate portion 54*c* and the plate portion 55). A groove M between the pair of plate portions 55 defines an engagement roller positioning space, and an engagement roller 112 belonging to the sewing frame actuation block 60 is positioned in the space. The pair of plate portions 55 are parallel to each other and also parallel to the plate portions 54*b* and 54*c*. The cross sectional profile of the long side 54 is as mentioned above, and the long side 52 and the short sides 56 and 58 are also formed so as to assume a same cross sectional profile. Within boundaries between the long sides 52 and 54 and the short sides 56 and 58, vertical plate portions (e.g., the plate portions 54*b*, 54*c*, and 55 in the long side 54 of the embodiment) abut against, at right angles, corresponding plate portions of adjacent sides. As mentioned above, the entirety of the sewing frame body 51 is integrally formed and supported by movable members 87, 107, and 137 belonging to the sewing frame actuation block 60.

The clips 59 are formed inside the sewing frame body 51. Each of the clips 59 includes a frame-like plate portion 59*a* continually extending from an inner lower end of the sewing frame body 51, a belt-like projection 59*b* formed on an upper surface of the plate-like portion 59*a*, and a cap portion 59*c* removably attached to the projection 59*b*. Processed fabric is stretchedly nipped between the projection 59*b* and the cap portion 59*c*.

As shown in FIGS. 1 through 4, the sewing frame 50 is equipped with connection members 49 that connect the sewing frame 50 to the movable members 87 and 107 belonging to the front-back direction actuation block 71. Specifically, the connection members 49 are provided at end areas of upper surfaces of the long sides 52 and 54 of the sewing frame body 51 of the sewing frame 50 in its longitudinal direction (i.e., the upper surfaces can also be said to be end areas of the upper surfaces of the short sides 56 and 58 in its longitudinal direction) (in other words, a total of four connection members 49 are attached to the sewing frame 50). The connection members 49 are attached to the movable members 87 and 107 of the front-back direction actuation block 71. Alternatively, the connection members 49 can also be attached to upper surfaces of the short sides 56 and 58 (preferably areas of upper surfaces of the short sides 56 and 58 close to the long sides 52 and 54). Each of the connection members 49 assumes a shape defined by bending an elongated square plate-like member into the shape of the letter L; namely, the connection member is formed into the shape of the letter L from a horizontal member 49*a* and a vertical member 49*b*.

The sewing frame actuation block 60 is for actuating the sewing frame 50 in both the right-left direction and the front-back direction and includes the front-back direction actuation blocks 70 and 71 for actuating the sewing frame 50 in the front-back direction and the right-left direction actuation block 130 for actuating the sewing frame 50 in the right-left direction. The front-back direction actuation block 70 is provided in number equal to the pair of cutouts formed in the table 30; namely, the two front-back direction actuation blocks 70 are provided. The two front-back direction actuation blocks 71 are also provided. Moreover, the right-left direction actuation block 130 is provided in number equal to the pair of openings formed in the table 30, and the three pairs (a total of six) of right-left direction actuation blocks 130 are provided.

Figure 5:
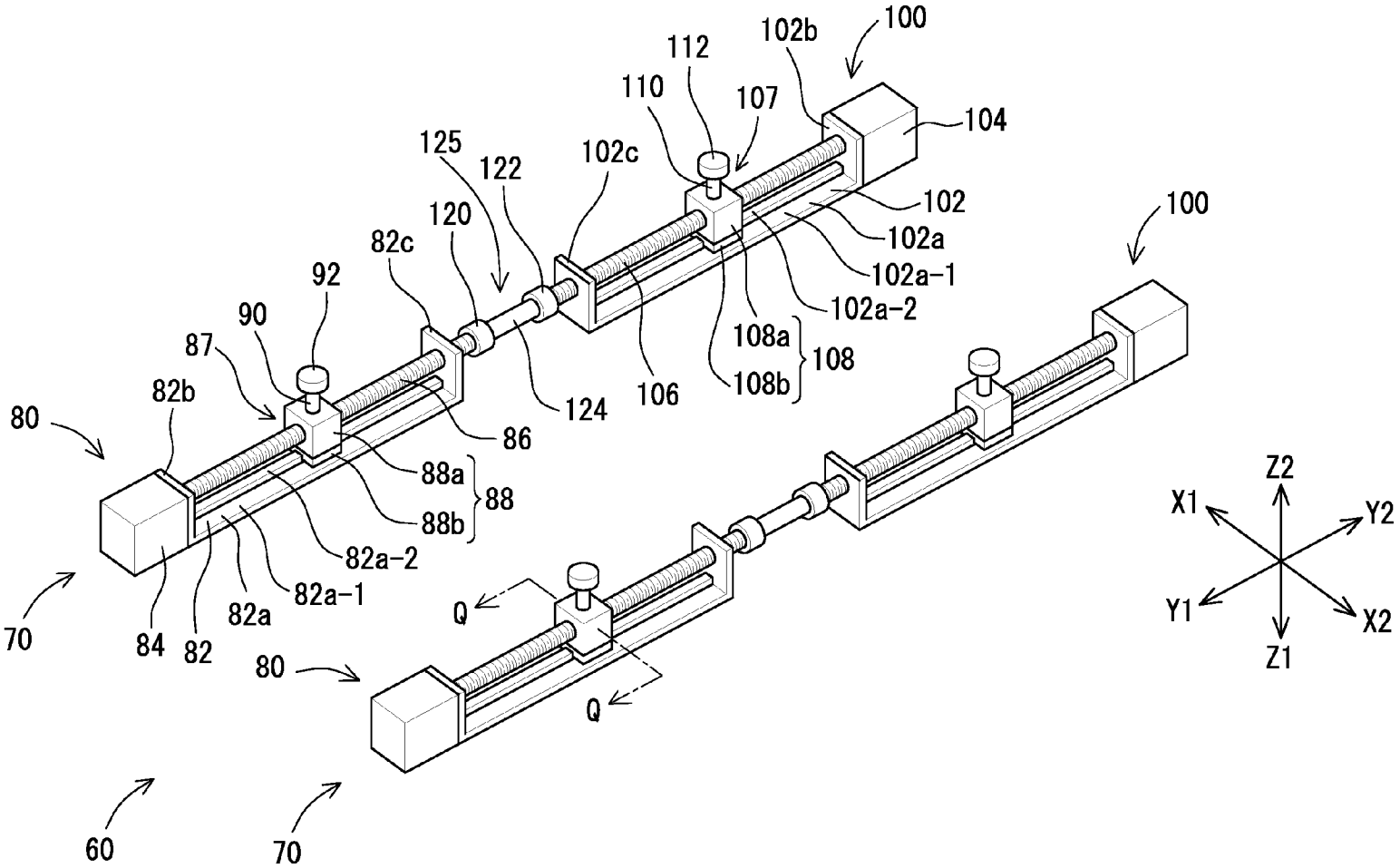
FIG. 5 It is a perspective view of a principal block of a sewing frame actuation block of the embodiment of the present invention.

As shown in FIG. 5, the front-back direction actuation block 70 (a first front-back direction actuation block) includes the ball screw mechanism blocks 80 and 100, couplings 120 and 122, and a joint member 124.

The ball screw mechanism block 80 includes a bracket 82 (which may also be embodied as a "support frame," and the same also applies to its counterpart) to be attached to the upper surface of the bed 20, a motor 84 (a first motor), a ball screw 86 (a first ball screw) that is supported by the bracket 82 in a rotatable fashion and that is connected at one end thereof to and rotated by the motor 84, and the movable member 87 (a first movable member) that is screw-engaged with the screw ball in a screwable manner as a result of rotation of the ball screw 86.

The bracket 82 includes an elongated rectangular substantially-plate-like horizontal member 82 that is horizontally placed; a plate-like upright portion 82*b* that stands upright on one end of the horizontal member 82*a* (i.e., an end facing the motor); and a plate-like upright portion 82*c* that stands upright on the other end of the horizontal member 82*a*. The horizontal member 82*a* has a plate-like portion 82*a*-1 assuming the shape of an elongated rectangular plate and a rail portion 82*a*-2 that is laid on an upper surface of the plate-like portion 82*a*-1 and along its longitudinal direction in parallel with the ball screw 86. The upright portions 82*b* and 82*c* axially support the ball screw 86 in a rotatable manner. Specifically, each of the upright portions 82*b* and 82*c* is provided with a bearing (not shown). The ball screw 86 is axially supported by means of the bearings. The motor 84 is fixed to the outside of the upright portion 82*b*, and an output shaft of the motor 84 is fixed to an end of the ball screw 86.

A thread groove used for screw engagement with the movable member 87 is formed in a peripheral surface of the ball screw 86. An end of the ball screw 86 that is on the opposite side of the end facing the motor 84 is formed so as to protrude from the upright portion 82*c*. Specifically, the ball screw 86 is formed so as to protrude from the upright portion 82*c* that opposite to the side of the upright portion facing the motor.

The movable member 87 includes a nut 88, the shaft portion 90, and an engagement roller (an engagement member) 92. The nut 88 includes a nut body 88*a* screw-engaged with the ball screw 86 and a slider 88*b* secured to a lower surface of the nut body 88*a*. A groove to be engaged with the rail portion 82*a*-2 is provided on a lower surface side of the slider 88*b*, and the slider 88*b* performs sliding action along the rail portion 82*a*-2. A threaded bore with which the ball screw 86 is to be screw-engaged is formed in the nut body 88*a*. The nut 88 is thereby configured so as to move along the ball screw 86 as a result of rotation of the ball screw 86. For instance, the movable member 87 is configured so as to move forward as the motor 84 rotates clockwise. In contrast, the movable member 87 is configured so as to move backward as the motor 84 rotates counterclockwise. However, the movable member can be actuated in reverse.

The shaft portion 90 is fixedly attached to an upper surface of the nut body 88*a* and inserted into the cutout 34*a* of the table 30 and the slit of the slit plate 38 with play; namely, allowance, to thus protrude from the upper surface of the table 30. The shaft portion 90 is inserted into the cutout 34*a* and the slit plate 38 while spaced apart from their edges. The engagement roller 92 is axially attached to a shaft portion 90 so as to become rotatable and protrude upward from the upper surface of the table 30. The engagement roller 92 provided so as to be rotatable with respect to the shaft portion 90 is engaged with a groove of the long side 52 of the sewing frame 50.

The ball screw mechanism block 100 is structurally same to the ball screw mechanism block 80; hence, its detailed descriptions are omitted. Specifically, the ball screw mechanism block 100 has a bracket 102 attached to the upper surface of the bed 20, a motor 104 (a second motor), a ball screw 106 (a second ball screw) that is supported by the bracket 102 in a rotatable fashion and that is connected at one end thereof to and rotated by the motor 104, and the movable member 107 (a second movable member) that is screw-engaged with the ball screw in a screwable manner as a result of rotation of a ball screw 106. The bracket 102, the motor 104, and the ball screw 106 are same in structure to their counterparts; namely, the bracket 82, the motor 84, and the ball screw 86. The bracket 102 has a horizontal member 102*a*, which includes a plate-like portion 102*a*-1 and a rail portion 102*b*-2, and upright portions 102*b* and 102*c*. The movable member 107 is same in structure of the movable member 87 and has a nut 108, the shaft portion 110, and the engagement roller (an engagement member) 112. The nut 108 includes a nut body 108*a* screw-engaged with the ball screw 106 and a slider 108*b* secured to a lower surface of the nut body 108*a*. A groove to be engaged with the rail portion 102*a*-2 is formed in a lower surface of the slider 108*b* that slides along the rail portion 102*a*-2, and the slider 108*b* thereby moves along the ball screw 106 as the ball screw 106 rotates. For instance, the movable member 107 is configured so as to move backward as the motor 104 rotates clockwise. The movable member 107 is configured so as to move forward as the motor 104 rotates counterclockwise. The movable member can also be actuated in reverse. The movable member 107 is spaced apart from the movable member 87. The shaft portion 110 of the front-back direction actuation block 70 is inserted into the cutout 34*b* of the table 30 and the slit of the slit plate 38 with play so as to protrude from the upper surface of the table 30. The engagement roller 112 provided so as to be rotatable with respect to the shaft portion 110 is engaged with the groove of the long side 54 of the sewing frame 50.

In one front-back direction actuation block 70, the ball screw mechanism block 80 and the ball screw mechanism block 100 are disposed opposite each other. Specifically, the ball screw mechanism block 80 and the ball screw mechanism block 100 are placed in such a way that portions of the blocks where the motors 84 and 104 are set face outside. A first actuation block, which is referred to in claims, is built from the motors 84 and 104 in the front-back drive block 70.

Figure 9:
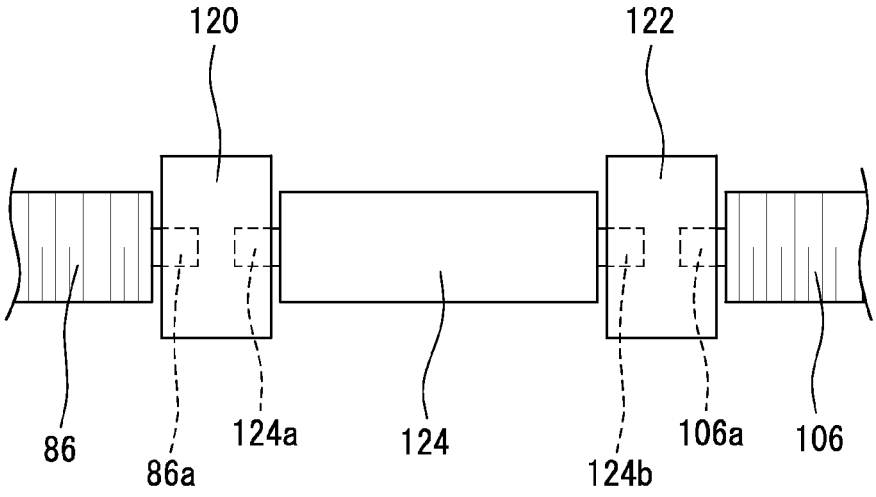
FIG. 9 It is a plan view showing a principal block of a front-back direction actuation block; in particular, a plane view showing a state of two ball screws coupled together.

The couplings 120 and 122 are shaft couplings. The coupling 120 coaxially couples the ball screw 86 to the joint member 124, and the coupling 122 coaxially couples the ball screw 106 to the joint member 124. Specifically, as shown in FIG. 9, a shaft portion 86*a* protruding from an extremity of the ball screw 86 fits into one of holes of the coupling 120, whereas a shaft portion 106*a* protruding from the extremity of the ball screw 106 fits into one of the holes of the coupling 122. The joint member 124 is a shaft-shaped member and formed into the shape of; for instance, a columnar shaft. The joint member 124 joins an end of the ball screw 86 facing the ball screw 106 to an end of the ball screw 106 facing the ball screw 86. Specifically, as shown in FIG. 9, a shaft portion 124*a* protruding from one end of the joint member 124 fits into the remaining hole of the coupling 120, and a shaft portion 124*b* protruding from the other end of the joint member 124 fits into the remaining hole of the coupling 122.

Figure 10:
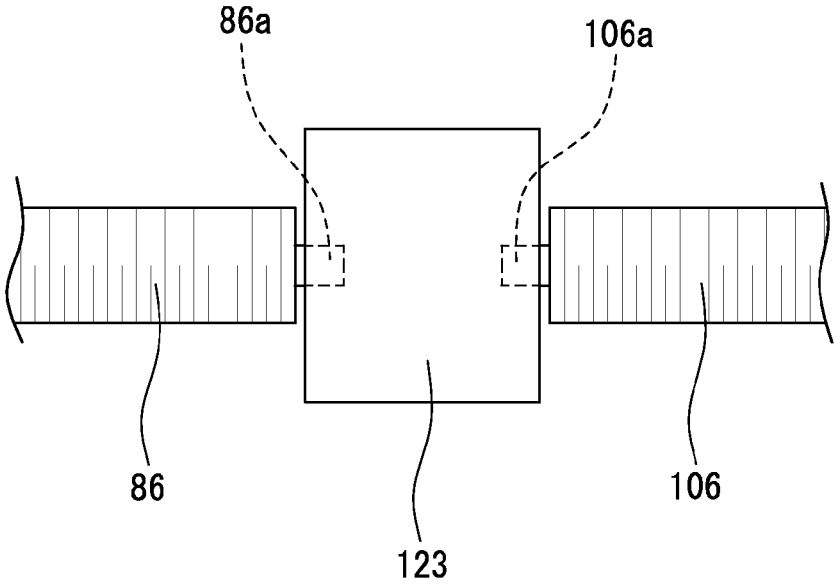
FIG. 10 It is a plan view showing the principal block of a front-back direction actuation block and, in particular, a plane view showing another example state of the two ball screws coupled together.

The joint member 124 and the couplings 120 and 122 can also be built from one coupling (a joint member). Specifically, as shown in FIG. 10, the shaft portion 86*a* protruding from the extremity of the ball screw 86 can also be configured so as to fit into one of holes of a coupling 123, and the shaft portion 106*a* protruding from an extremity of the ball screw 106 can also be configured so as to fit into the remaining hole of the coupling 123.

As above, the ball screw 86, the joint member 124, and the ball screw 106 are entirely built in one piece from the coupling members 120 and 122, thereby forming one shaft-shaped member 125. The ball screw 86, the joint member 124, and the ball screw 106 are joined together in such a way that their axial lines are aligned to each other. The shaft-shaped members 125 of the respective front-back direction actuation blocks 70 correspond to a "ball screw for first front-back direction actuation block" and "first space holding means" referred to in the claims. Further, a configuration of the front-back direction actuation block 70 except the motors 84 and 104 and the movable members 87 and 107 corresponds to a support that supports the first actuation block (the motors 84 and 104) and that support the first movable member (the movable member 87) and the second movable member (the movable member 107) so as to be movable in the front-back direction. In the ball screw mechanism block 80, the bracket 82 and the ball screw 86 correspond to a support that supports the first actuation block (the motor 84) and that supports the first movable member so as to be movable in the front-back direction. In the ball screw mechanism block 100, the bracket 102 and the ball screw 106 correspond to a support that supports the first actuation block (the motor 104) and that supports the second movable member so as to be movable in the front-back direction.

The plurality of front-back direction actuation blocks 70 are provided in parallel with each other along the front-back direction. The plurality of front-back direction actuation blocks 70 are configured in such a way that the movable members 87 and 107 move in parallel with each other. The front-back direction actuation blocks 70 have the same configuration.

Each of the front-back direction actuation blocks 70 is provided with two motors; namely, the motor 84 and the motor 104. The motors 84 and 104 are synchronously driven. The engagement roller 92 of the ball screw mechanism block 80 in the front-back direction actuation block 70 is engaged with the groove M of the long side 52 of the sewing frame 50, and the engagement roller 112 of the ball screw mechanism block 100 is engaged with the groove M of the long side 54 of the sewing frame 50.

Figure 4:
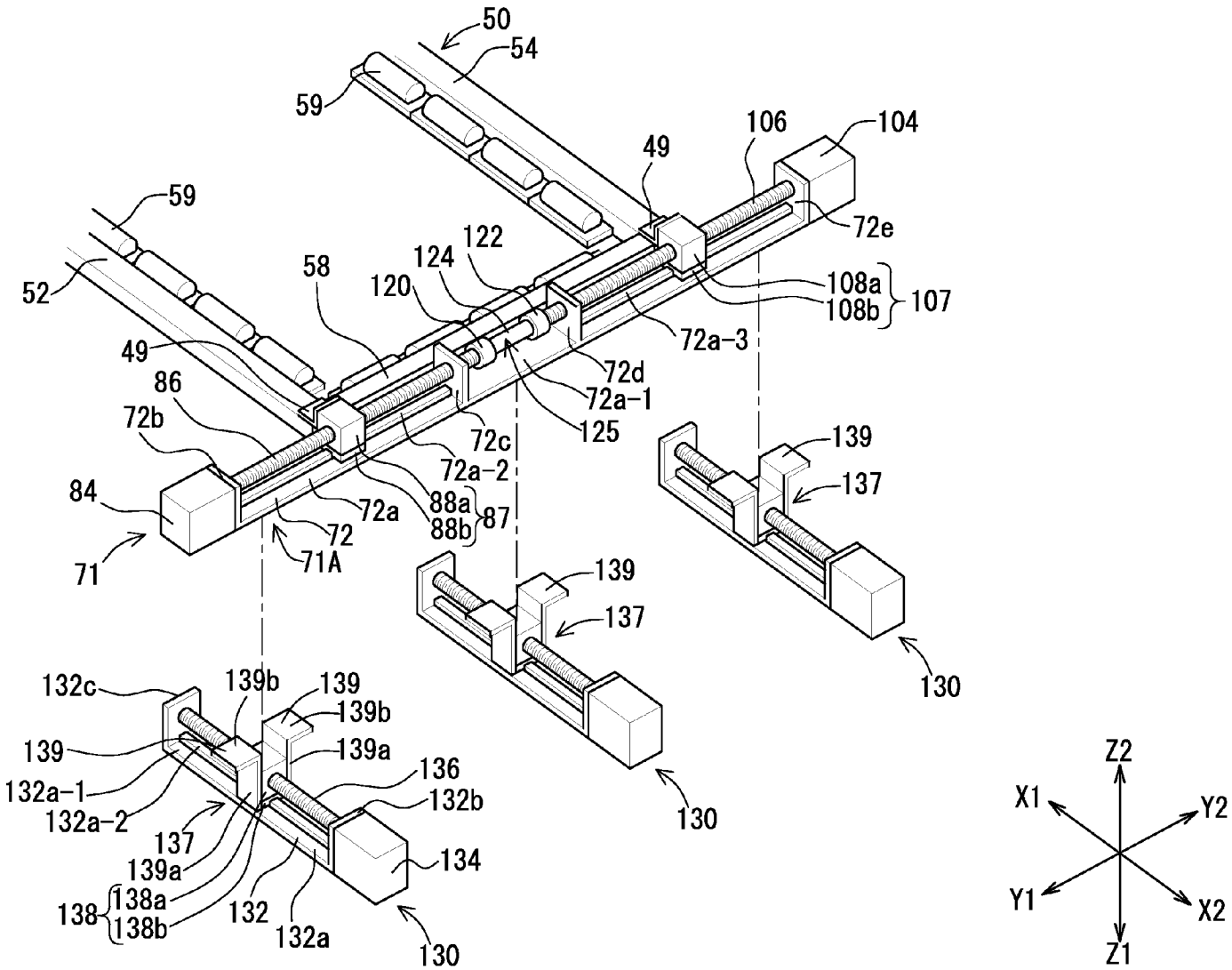
FIG. 4 It is an exploded perspective view of the principal block of the sewing machine of the embodiment of the present invention.

The front-back direction actuation block 71 (a second front-back direction actuation block) is substantially analogous in structure to the front-back direction actuation block 70. However, they differ from each other in that a plate-like portion 72*a*-1 making up a bracket 72 is integrally formed as shown in FIG. 4.

Specifically, the front-back direction actuation block 71 has the bracket 72 (a support or a support frame); the motor 84 (a third motor); the ball screw 86 (a third ball screw); the movable member 87 (a third movable member); the motor 104 (a fourth motor); the ball screw 106 (a fourth ball screw); the movable member 107 (a fourth movable member); the couplings 120 and 122; and the joint member 124.

The bracket 72 has a horizontal member 72*a* that assumes an elongated rectangular substantially-plate-like shape and that is horizontally provided; a plate-like upright portion 72*b* standing upright on one end of the horizontal member 72*a* (an end facing the motor 84); a plate-like upright portion 72*e* standing upright on the other end of the horizontal member 72*a* (an end facing the motor 104); and plate-like upright portions 72*c* and 72*d* spaced apart from each other at an interval on an upper surface of the horizontal member 72*a* and between the upright portions 72*b* and 72*e*. The horizontal member 72*a* has the plate-like portion 72*a*-1 that assumes the shape of an elongated rectangular plate and that has a length equivalent to a distance from the upright portion 72*b* to the upright portion 72*e*; a rail portion 72*a*-2 laid, along a longitudinal direction, between the upright portions 72*b* and 72*c* on an upper surface of the plate-like portion 72*a*-1 and in parallel with the ball screw 86; and a rail portion 72*a*-3 that is laid between the upright portions 72*d* and 72*e* on the upper surface of the plate-like portion 72*a*-1 and along its longitudinal directional in parallel with the ball screw 106.

The upright portions 72*b* and 72*c* axially support the ball screw 86 in a rotatable manner, and the upright portions 72*d* and 72*e* axially support the ball screw 106 in a rotatable manner. Specifically, each of the upright portions 72*b*, 72*c*, 72*d*, and 72*e* is provided with a bearing (not shown), and the ball screws 86 and 106 are axially supported by means of the bearings. More specifically, in relation to the bracket 82 and the bracket 102 in the front-back direction actuation block 70, the plate-like portion 82*a*-1 and the plate-like portion 102*a*-1 are joined into one plate-like portion 72*a*-1, whereby the bracket 82 and the bracket 102 are integrally joined. The bracket 72 corresponds to a "support that supports the third ball screw, the third motor, the fourth ball screw, and the fourth motor."

The motor 84, the ball screw 86, the motor 104, the ball screw 106, and the couplings 120 and 122 are structurally same to their counterparts in the front-back direction actuation block 70, and hence their detailed explanations are omitted. The movable member 87 is structurally same to the nut 88 in the front-back direction actuation block 70, and the movable member 107 is structurally same to the nut 108 in the front-back direction actuation block 70. The movable member 87 and the movable member 107 are spaced apart from each other. The motor 84 and the motor 104 in the front-back direction actuation block 71 make up a second actuation block referred to in the claims.

Figure 3:
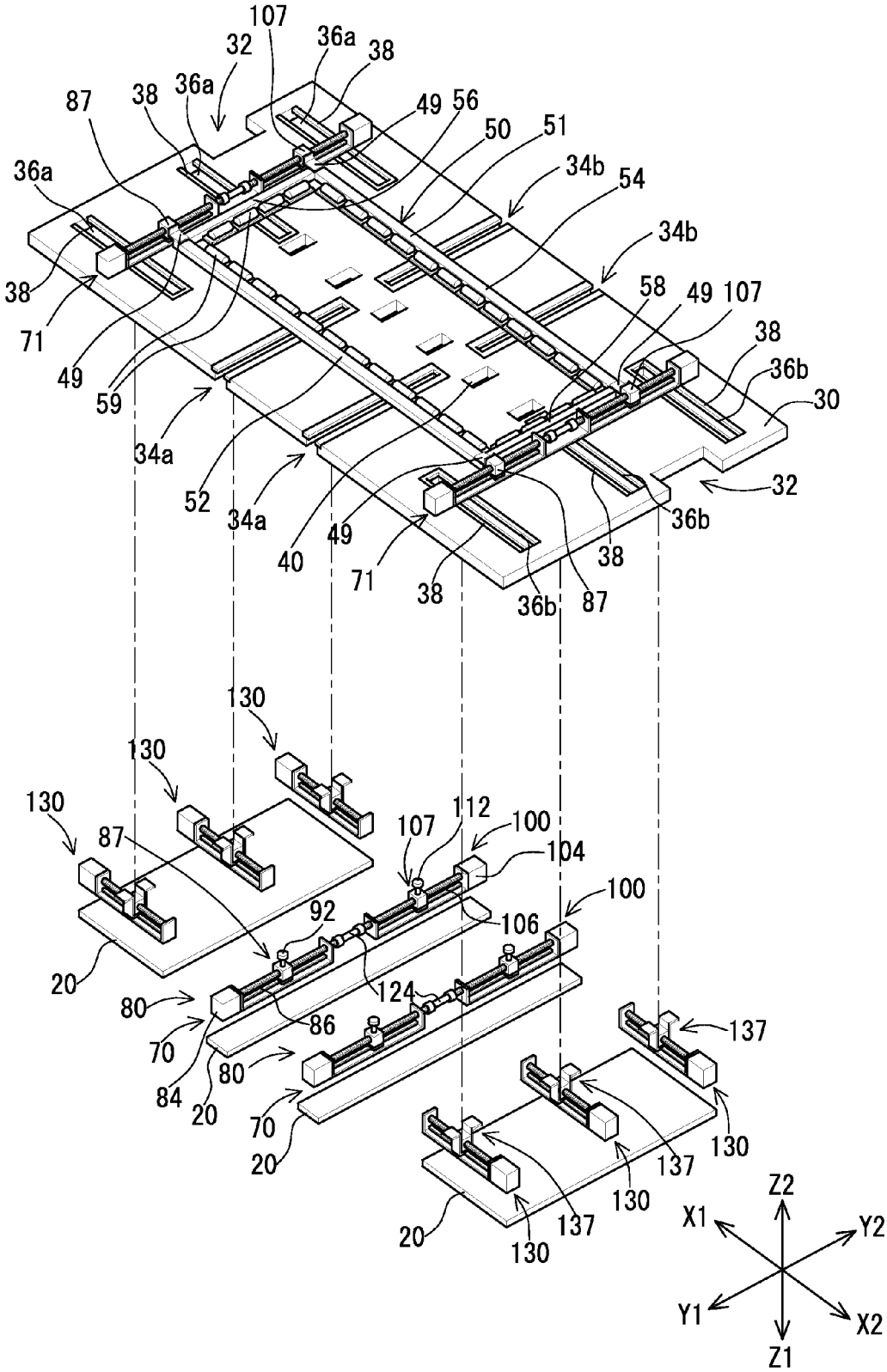
FIG. 3 It is an exploded perspective view of the principal block of the sewing machine of the embodiment of the present invention.
Figure 6:
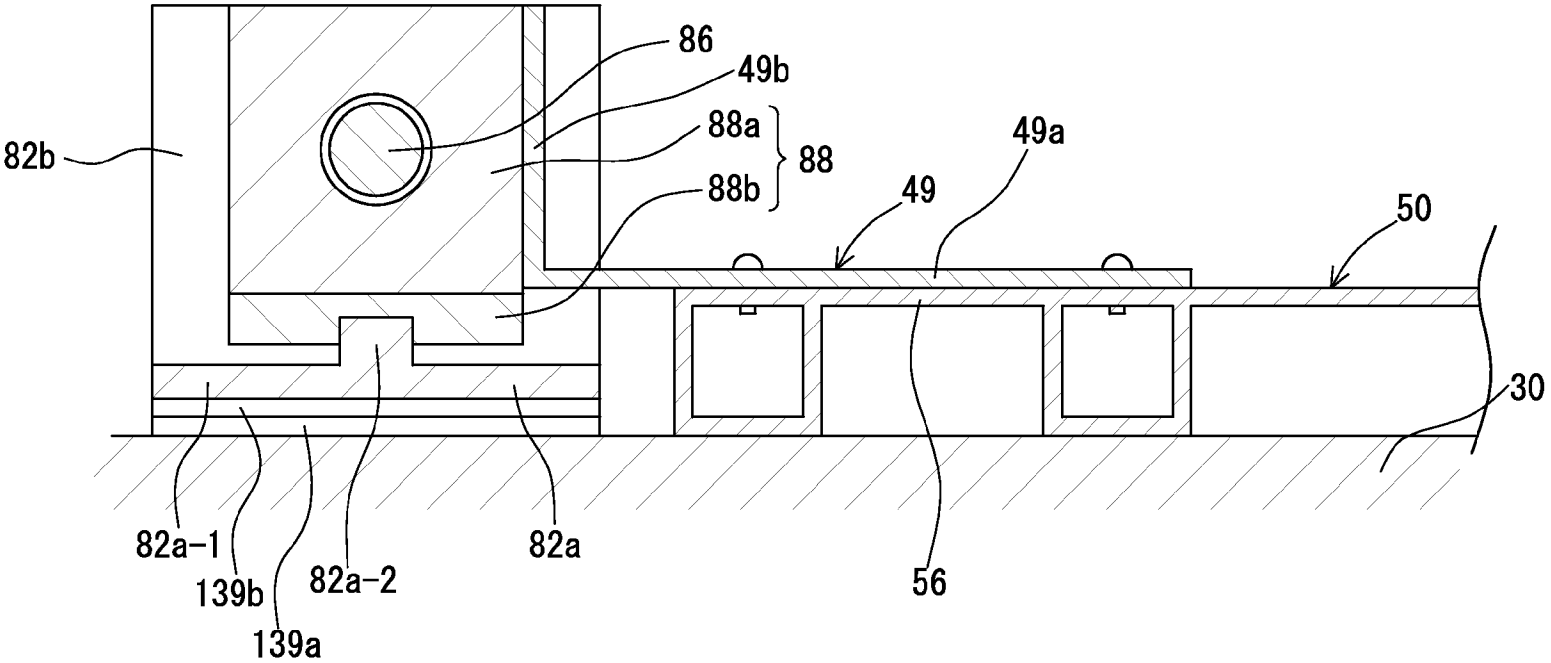
FIG. 6 It is a cross sectional view taken along line U-U shown in FIG. 1.
Figure 7:
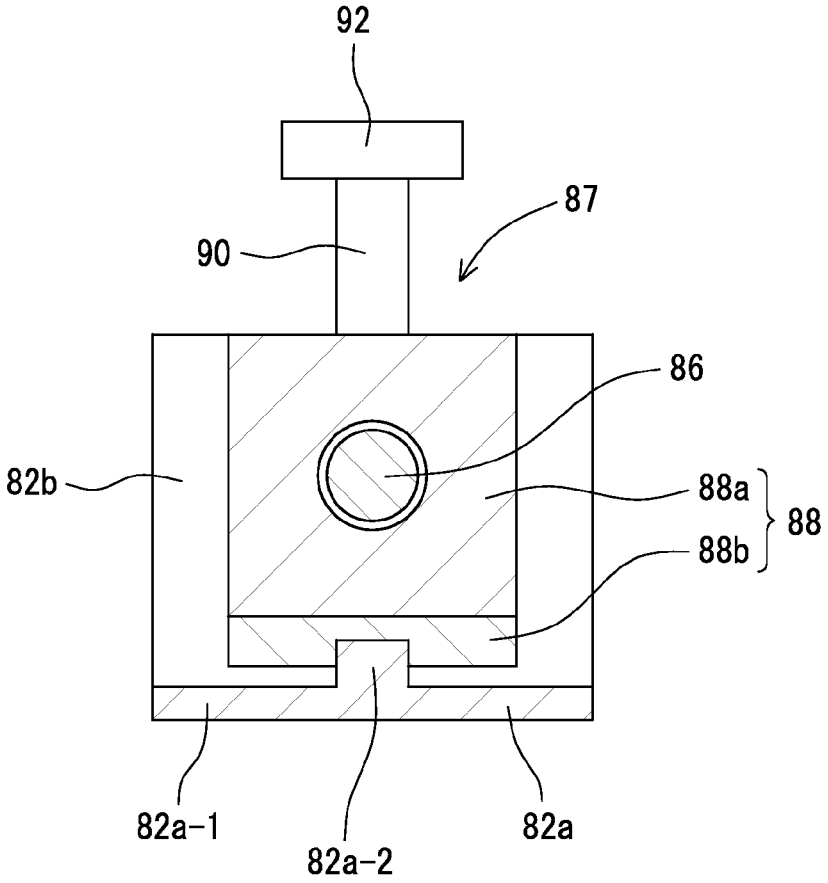
FIG. 7 It is a cross sectional view of a ball screw actuation mechanism that is a cross sectional elevation taken along line Q-Q shown in FIG. 5.

In the front-back direction actuation block 71, shaft portions are not put on upper surfaces of the movable members 87 and 107 as distinct from the movable members 87 and 107 of the front-back direction actuation block 70. The connection members 49 are attached to side surfaces of the respective movable members 87 and 107 facing the sewing frame 50. The movable members 87 and 107 are fastened to the short sides 56 and 58 of the sewing frame 50 by way of the connection members 49. Specifically, as shown in FIGS. 3 and 6, a state of connection between the movable member 87 and the short side 56 is taken as an example. The plate-like vertical member 49*b* of the connection member 49, which is formed by bending a plate-like member into the shape of the letter L, is fastened to a side surface of the movable member 87 facing the sewing frame 50. Further, the plate-like horizontal member 49*a* of each of the connection members 49 is secured to the short side 56 of the sewing frame 50, whereby the movable member 87 and the short side 56 are fixedly connected together. The movable member 107 and the short side 56, the movable member 87 and the short side 58, and the movable member 107 and the short side 58 are likewise fixedly connected together by means of the connection members 49. As mentioned above, the sewing frame 50 and the front-back direction actuation block 71 are placed substantially flush with each other; specifically, a lower end of the sewing frame 50 and a lower end of the bracket 72 are placed substantially flush with each other. The bracket 72 of the front-back direction actuation block 71 is placed at an elevated location that is slightly higher than the upper surface of the table 30. In FIGS. 1 through 4, the connection members 49 are connected to corners of the sewing frame 50 (namely, areas where the short sides and the long sides abut each other). However, when thought is given to the fact that both the short sides 56 and 58 and the long sides 52 and 54 include the corners, the connection members 49 can be said to be attached to longitudinal ends of the respective long sides 52 and 54. Incidentally, the connection members 49 can also be attached to the short sides 56 and 58 except the corners of the sewing frame 50. Moreover, the long sides 52 and 54 can also be made longer, in the right-left direction, than respective ends of the short sides 56 and 58, and the connection members 49 can be attached to longitudinal ends of the long sides 52 and 54. As above, one front-back direction actuation block 71 is placed outside the lateral side of the sewing frame 50 along the short side 56, and the movable members 87 and 107 of the front-back direction actuation block 71 are connected to the sewing frame 50 by way of the connection members 49. Further, the other front-back direction actuation block 71 is placed outside the lateral side of the sewing frame 50 along the short side 58. The movable members 87 and 107 of the other front-back direction actuation block 71 are connected to the sewing frame 50 by way of the connection members 49.

Even in each of the front-back direction actuation blocks 71, the ball screw 86, the joint member 124, and the ball screw 106 are entirely formed into one by means of the couplings 120 and 122 in the same way as in the front-back direction actuation blocks 70, whereby one shaft-shaped member 125 is built. The ball screw 86, the joint member 124, and the ball screw 106 are joined together in such a way that their axial lines are aligned to each other. The shaft-shaped members 125 of the front-back direction actuation blocks 71 correspond to "ball screws for second front-back direction actuation blocks" and "second space holding means" referred to in the claims. The configuration of the front-back direction actuation blocks 71 except the motors 84 and 104 and the movable members 87 and 107 (i.e., the bracket 72, the ball screws 86 and 106, the couplings 120 and 122, and the joint member 124) makes up a "support 71A that supports the second actuation block (the motors 84 and 104) and that supports the third movable member (the movable member 87) and the fourth movable member (the movable member 107) so as to be movable in the front-back direction."

The two front-back direction actuation blocks 70 and the two front-back direction actuation blocks 71 are placed in parallel with each other. The ball screws 86 and 106 of the respective front-back direction actuation blocks 70 and the ball screws 86 and 106 of the respective front-back direction actuation blocks 71 are placed in parallel with each other. The movable members 87 and 107 of the front-back direction actuation blocks 70 and 71 are disposed so as to be movable in the front-back direction.

The front-back direction actuation blocks 71 placed along the short side 56 are supported by the movable members 137 (to be exact, the support members 139) of the right-left direction actuation blocks 130 placed in correspondence with the respective openings 36*a*. The front-back direction actuation blocks 71 placed along the short side 58 are supported by the movable members 137 (to be exact, the support members 139) of the right-left direction actuation blocks 130 placed in correspondence with the respective openings 36*b*.

The right-left direction actuation blocks 130 are structurally analogous to the ball screw mechanism blocks 80 and 100 except that the ball screws 136 do not protrude from respective upright portions 132*c* and that the movable members 137 structurally differ from the movable members 87 and 107. Specifically, each of the right-left direction actuation blocks 130 has a bracket 132 secured to the upper surface of the bed 20, a motor 134 (a third actuation block), the ball screw 136 (a fifth ball screw) that is supported by the bracket 132 in a rotatable fashion and that is connected at one end to the motor 134 and rotated by the motor 134, and the movable member 137 (a fifth movable member) that is screw-engaged with the ball screw in a screwable manner as a result of rotation of the ball screw 136. The bracket 132 and the motor 134 are structurally analogous to the bracket 82 and the motor 84. The bracket 132 has a horizontal member 132*a*, which includes a plate-like portion 132*a*-1 and a rail portion 132*a*-2, and upright portions 132*b* and 132*c*. A thread groove used for screw engagement with the movable member 137 is formed in a peripheral surface of the ball screw 136. An end of the ball screw 136 that is on the opposite side of the end facing the motor 134 does not to protrude from the upright portion 132*c*. Specifically, the movable member 137 (the fifth movable member) includes a nut 138 and the pair of support members 139 fastened to both sides of the nut 138. The nut 138 includes a nut body 138*a* screw-engaged with the ball screw 136 and a slider 138*b* secured to a lower surface of the nut body 138*a*. A groove to be engaged with the rail portion 132*a*-2 is provided on a lower surface side of the slider 138*b*, and the slider 138*b* performs sliding action along the rail portion 132*a*-2. The nut 138 is thereby configured so as to move along the ball screw 136 as a result of rotation of the ball screw 136. For instance, the movable member 137 is configured so as to move toward the motor 134 as the motor 134 rotates clockwise. In contrast, the movable member 137 is configured so as to move in a direction opposite to the motor 134 as the motor 134 rotates counterclockwise. However, the movable member can be actuated in reverse.

As shown in FIG. 4, the support member 139 assumes a shape made by bending an elongated square plate-like member into the shape of the letter L. The support member 139 is formed into a substantially L-shaped geometry from a plate-like vertical member 139*a* provided in the vertical direction and a plate-like horizontal member 139*b* provided in a horizontal direction from an upper end of the vertical member 139*a*. In the pair of support members 139, the vertical members 139*a* are fixed to both sides of each of the nuts 138 (in particular, the nut body 138*a*) (namely, lateral sides of the nuts oriented in a direction perpendicular to the direction of movement of the movable member 137). The horizontal members 139*b* are provided so as to face outside with reference to the vertical members 139*a* continually leading from the respective horizontal members. The two horizontal members 139*b* are formed to the same height, and upper surfaces of the two horizontal members 139*b* are fixed to a lower surface of the plate-like portion 72*a*-1 of the front-back direction actuation block 71.

The pair of right-left direction actuation blocks 130 are provided for each pair of openings including the opening 36*a* and the opening 36*b*. Three pairs of right-left direction actuation blocks 130 (a total of six right-left direction actuation blocks) are provided. The pair of right-left direction actuation blocks 130 corresponding to one pair of openings are provided so as to oppose each other (motors are respectively disposed at the outside of the pair of right-left direction actuation blocks 130 as shown in FIGS. 1 and 3). The mutually-opposed right-left direction actuation blocks 130 are configured such that one ball screw 136 comes to an extension of the other ball screw 136. The right-left direction actuation blocks 130 each have the same configuration.

The three right-left direction actuation blocks 130 provided in correspondence with the respective openings 36*a* are placed in parallel with each other. In connection with the front-back direction, the center right-left direction actuation block 130 of the three right-left direction actuation blocks 130 is placed at a substantially intermediate position of a front-back-oriented length of the front-back direction actuation block 70. The other two right-left direction actuation blocks 130 are substantially equidistant from the center right-left direction actuation block 130. The ball screws 136 of the right-left direction actuation blocks 130 (i.e., the right-left direction actuation blocks 130 located close to the short side 56) provided in correspondence with the respective openings 36*a* correspond to the fifth ball screws. Likewise, the three right-left direction actuation blocks 130 provided in correspondence with the respective openings 36*b* are placed in parallel with each other. In connection with the front-back direction, the center right-left direction actuation block 130 of the three right-left direction actuation blocks 130 is placed at a substantially intermediate position of the front-back-oriented length of the front-back direction actuation blocks 71. The other two right-left direction actuation blocks 130 are substantially equidistant from the center right-left direction actuation block 130. The ball screws 136 of the right-left direction actuation blocks 130 (i.e., the right-left direction actuation blocks 130 located close to the short side 58) provided in correspondence with the respective openings 36*b* correspond to sixth ball screws. Either the right-left direction actuation block 130 provided in correspondence with the opening 36*a* or the right-left direction actuation block 130 provided in correspondence with the opening 36*b* serves as a first right-left direction actuation block, and a remaining right-left direction actuation block serves as a second right-left direction actuation block. The motor 134 of the first right-left direction actuation block serves as a fifth motor, whilst the motor 134 of the second right-left direction actuation block serves as a sixth motor. In the fifteenth configuration, the motor 134 of the right-left direction actuation block 130 serves as the fifth motor.

As above, the front-back direction actuation block 71 is supported by means of the movable members 137 of the three right-left direction actuation blocks 130.

A direction of the ball screws 86 and 106 of the respective front-back direction actuation blocks 70 and 71 and a direction of the ball screws 136 of the respective right-left direction actuation blocks 130 are arranged at right angles to each other when viewed in plane.

The thread grooves formed in the respective peripheral surfaces of the ball screws 86, 106, and 136 making up the sewing frame actuation block 60 are formed at the same pitch in the same direction of rotation.

The control circuit 200 is a circuit for controlling operation of the motors 84, 104, and 134 of the sewing frame actuation block 60 and is connected to all of the motors in the sewing frame actuation block 60, thereby controlling operations of the respective motors. In relation to operation control of the motors 84 and 104 in the front-back direction actuation blocks 70 and 71, the control circuit 200 synchronously controls all of the motors 84 and 104 in the front-back direction actuation blocks 70 and 71. In particular, since the ball screws 86 and 106 are entirely formed integrally with the joint members 124, the motors 84 and 104 of one of the front-back direction actuation blocks 70 and 71 are synchronously controlled. Moreover, the respective motors 84 of the plurality of front-back direction actuation blocks 70 and 71 are also synchronously controlled, and the respective motors 104 of the plurality of front-back direction actuation blocks 70 and 71 are also synchronously controlled. Since the ball screws 86 and 106 are coupled together, the motor 84 and the motor 104 in each of the single the front-back direction actuation block 70 and the single front-back actuation 71 are controlled so as to rotate in opposite directions. Specifically, in each of the front-back direction actuation blocks 70, the motor 84 of the ball screw mechanism block 80 that actuates the long side 52 and the motor 104 of the ball screw mechanism block 100 that actuates the long side 54 are controlled so as to rotate in opposite directions. Likewise, even in each of the front-back direction actuation blocks 71, the motor 84 and the motor 104 are controlled so as to rotate in opposite directions. As mentioned above, in all of the plurality of front-back direction actuation blocks 70 and 71, operation of the motors 84 and 104 is controlled in such a way that the movable members 87 and 107 of the front-back direction actuation blocks 70 become equal to the movable members 87 and 107 of the front-back direction actuation blocks 71 in terms of a direction of movement and a movement distance.

Even in relation to operation control of the motors 134 of the right-left direction actuation blocks 130, the control circuit 200 synchronously controls all of the motors of the right-left direction actuation blocks 130. The motors 134 of the right-left direction actuation blocks 130 that actuate the front-back direction actuation blocks 71 connected to the short side 56 and the motors 134 of the right-left direction actuation blocks 130 that actuate the front-back direction actuation blocks 71 connected to the short side 58 are controlled so as to rotate in opposite directions. Operation of the motors 134 is controlled such that the movable members 137 in the respective right-left direction actuation blocks 130 become equal to each other in terms of a direction of movement and a movement distance.

In reality, the control circuit 200 has a storage device that stores programs for controlling operation of the motors, a CPU that controls the motors according to the programs stored in the storage device, and others.

Operation of the sewing machine 5 having the foregoing configuration is now described. While the sewing frame 50 is being actuated in the front-back direction and the right-left direction with processed fabric stretched across the sewing frame 50, the processed fabric is sewn (in particular, embroidered) by means of cooperative operation between a needle that is provided in the sewing head 22 and vertically actuated and the shuttle to be rotatively actuated.

In order to stretch the processed fabric across the sewing frame 50, the fabric is nipped between the projection 59*b* and the cap portion 59*c*.

In the sewing machine 5, the sewing frame 50 is actuated in both the front-back direction and the right-left direction under control of the control circuit 200. Specifically, the motors 84 and 104 of the front-back direction actuation blocks 70 and 71 are operated under control of the control circuit 200. As the motors 84 and 104 are driven, the ball screws 86 and 106 are rotated. As the ball screws 86 and 106 rotate, the movable members 87 and 107 move. Specifically, in each of the front-back direction actuation blocks 70, the movable member 87 moves in the front-back direction along the ball screw 86 and the rail portion 82*a*-2, and the movable member 107 moves in the front-back direction along the ball screw 106 and the rail portion 102*a*-2. In each of the front-back direction actuation blocks 71, the movable member 87 moves in the front-back direction along the ball screw 86 and the rail portion 72*a*-2, and the movable member 107 moves in the front-back direction along the ball screw 106 and the rail portion 72*a*-3. Further, under control of the control circuit 200, the motors 134 of the respective right-left direction actuation blocks 130 are driven. As the motors 134 are driven, the ball screws 136 rotate. Further, as the ball screws 136 rotate, the movable members 137 move in the right-left direction.

In each of the front-back direction actuation blocks 70, the engagement roller 92 supported by the nut 88 by way of the shaft portion 90 comes into engagement with the long side 52 of the sewing frame 50. Further, the engagement roller 112 supported by the nut 108 by way of the shaft portion 110 comes into engagement with the long side 54 of the sewing frame 50. Further, in each of the front-back direction actuation blocks 71, the movable members 87 and 107 are connected to the sewing frame 50 by way of the respective connection members 49. Therefore, the sewing frame 50 moves in the front-back direction as the movable members 87 and 107 are actuated. Further, the movable members 137 of the respective right-left direction actuation blocks 130 are fastened to the brackets 72 of the front-back direction actuation blocks 71. As the movable members 137 move, the sewing frame 50 moves in the right-left direction. On that occasion, the engagement rollers 92 engaged with the long side 52 slide along the groove M of the long side 52 with which the engagement rollers 92 remain in engagement, whereby the engagement rollers 112 engaged with the long side 54 slide along the groove M of the long side 54 with which the engagement rollers 112 remain in engagement.

In the sewing machine 5 of the present embodiment, all of the four sides of the sewing frame 50 are supported by means of the movable members (i.e., the pair of long sides 52 and 54 are supported by means of the movable members 87 and 107 of the front-back direction actuation block 70, and the pair of short sides 56 and 58 are supported by means of the movable members 87 and 107 of the front-back direction actuation block 71), whereby all of the sides of the sewing frame 50 are provided with the actuation mechanisms. Therefore, distortion of the sewing frame 50 can be minimized, and the sewing frame can be positioned with high accuracy.

Further, all of the sides of the sewing frame are provided with the actuation mechanisms, and all of the sides of the sewing frame are actively positioned, thereby preventing distortion of the sewing frame, which would otherwise occur even when the processed fabric is pulled inside by means of tensile force of the processed fabric developing during sewing operation. Since the ball screw generally exhibits high rigidity, the rigidity of the shaft-shaped member built from the ball screws 86 and 106 and the joint member 124 can also be enhanced despite the tensile force developing during sewing operation. A potential of occurrence of deflection in the shaft-shaped member is small.

In particular, in each of the front-back direction actuation blocks 70 supporting the long sides 52 and 54 of the sewing frame 50 and the front-back direction actuation blocks 71 supporting the short sides 56 and 58, the ball screw 86 and the ball screw 106 are built into one by way of the joint member 124. Therefore, even when an attempt is made to move the nut (the movable member in the front-back direction actuation block 71) against force of the motor as a result of distortion (in particular, inner distortion) of the sewing frame 50, a ball screw screw-engaged with the nut (the movable member) is configured integrally with the other ball screw. Hence, the nut is prevented from moving against the force of the motor. Specifically, when the processed fabric is pulled inside as the fabric is sewn, the long sides 52 and 54 of the sewing frame 50 are also pulled inside. However, if the ball screws 86 and 106 are not integrally formed by means of the joint member 124, the nuts 88 and 108 (the movable members 87 and 107 of the front-back direction actuation block 71) will rotate the ball screws 86 and 106 against force of the motor, which may move the nuts 88 and 108 (the movable members 87 and 107). In the present embodiment, when the long sides 52 and 54 are pulled inside, both the nuts 88 and 108 attempt to move inside. However, rotation of the ball screw 86 which will arise when the nut 88 attempts to move inside and rotation of the ball screw 106 which will arise when the nut 108 attempts to move inside are opposite in direction to each other. Therefore, the nut 88 and the nut 108 will not move inside. Even in the front-back direction actuation block 71, when the long sides 52 and 54 are pulled inside, both the movable member 87 and the movable member 107 will attempt to move inside. However, rotation of the ball screw 86 which will arise when the movable member 87 attempts to move inside and rotation of the ball screw 106 which will arise when the movable member 107 attempts to move inside are opposite in direction to each other. Therefore, the movable member 87 and the movable member 107 will not move inside. Therefore, the potential of occurrence of distortion in the long sides 52 and 54 of the sewing frame 50 is extremely small.

In the front-back direction actuation block 70, only movements of the nut 88 (108) are restricted by means of the ball screw 86 (106) and the rail portion 82*a*-2 (102*a*-2). Therefore, smooth movement of the nuts 88 and 108 can be performed. Likewise, even in the front-back direction actuation block 71, only movements of the movable member 87 (107) are restricted by means of the ball screw 86 (106) and the rail portion 72*a*-2 (72*a*-3). Therefore, smooth movement of the movable members 87 and 107 can be performed. Specifically, in a case where the nut is equipped with a joint bar as described in connection with Patent Documents 3 and 4, movements of the nut will be restricted by the joint bar. Therefore, if a direction of the joint bar is not accurately in parallel with the ball screw, the nut cannot smoothly move. In the case of the present embodiment, since the nut is not equipped with the joint bar, the nut can smoothly move without being restricted in its movements by the joint bar.

In the front-back direction actuation block 70, the shaft-shaped member built from the ball screws 86 and 106 and the joint member 124 is axially supported by the upright portions 82*c* and 102*c* as well as by the upright portions 82*b* and 102*b*. Further, in the front-back direction actuation block 71, the shaft-shaped member built from the ball screws 86 and 106 and the joint member 124 is axially supported by the upright portions 72*c* and 72*d* as well as by the upright portions 72*b* and 72*e*. For these reasons, occurrence of deflection in the shaft-shaped members can be prevented.

In the present embodiment, the front-back direction actuation block 71 is connected to the short sides 56 and 58 and the front-back direction actuation block 71 is configured so as to be actuated in the right-left direction by means of the right-left direction actuation block 130. Occurrence of deflection of the short sides 56 and 58 can be prevented. Further, since occurrence of deflection of deflection of the short sides 56 and 58 can be prevented, occurrence of deflection of the long sides 52 and 54 can also be prevented. Specifically, consideration is given to a case where the front-back direction actuation blocks 71 are not provided; where the movable members 137 of the respective right-left direction actuation blocks 130 are structurally analogous to the movable members 87; and the engagement rollers engage with the short sides 56 and 58. In this case, longitudinal end areas of the sewing frame 50 (namely, the areas close to the short sides 56 and 58) are not supported by the front-back direction actuation blocks 70. Hence, when processed fabric is pulled inside as the fabric is sewn, the longitudinal end areas of the sewing frame 50 may be deflected inside with respect to the front-back direction. However, in the present embodiment, the front-back direction actuation blocks 71 are connected to the short sides 56 and 58, and the longitudinal end areas of the sewing frame 50 are supported by the front-back direction actuation block. Hence, the longitudinal end areas of the sewing frame 50 achieved in the longitudinal direction will not be deformed with respect to the front-back direction.

In the above descriptions, the front-back direction actuation blocks 70 and the front-back direction actuation blocks 71 have been described that each include the ball screw 86 and the ball screw 106 which are joined by means of the joint member 124. However, as shown in FIGS. 11 and 12, all of the ball screws may also be embodied as a single ball screw.

Figure 12:
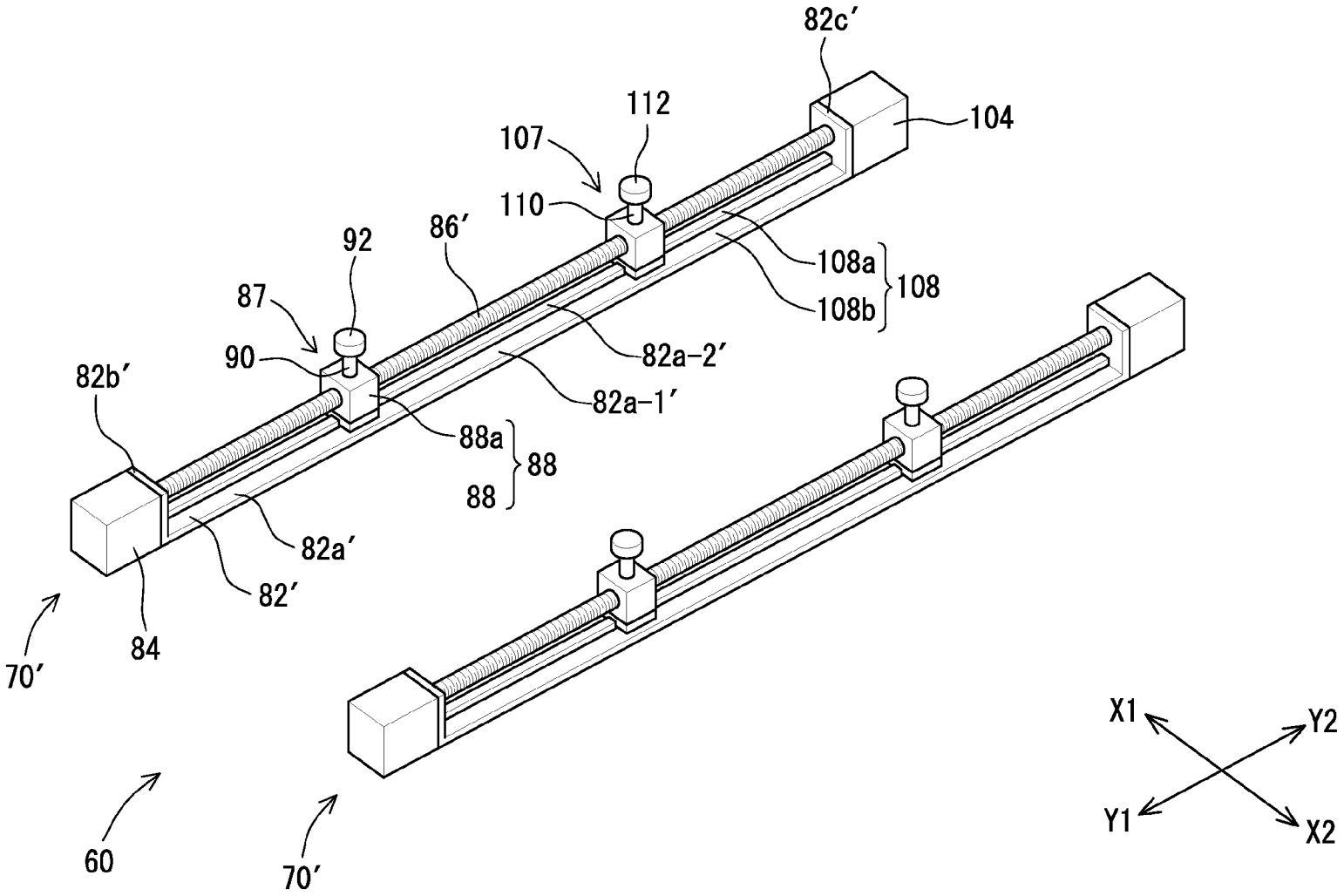
FIG. 12 It is a perspective view of a principal block of another example sewing frame actuation block.

Specifically, each of front-back direction actuation blocks 70' shown in FIG. 12 includes a bracket 82' attached to an upper surface of the bed 20; the motor 84 disposed at one end the bracket 82'; the motor 104 disposed at the other end the bracket 82'; a ball screw 86' that is rotatively supported by the bracket 82', connected at one end to the motor 84 and at the other end to the motor 104, and rotated by the motors 84 and 104; and the movable members 87 and 107 screw-engaged with the ball screw 86' so as to become screwable as the ball screw 86' rotates. The bracket 82' has a horizontal member 82*a*' that assumes an elongated rectangular substantially-plate-like shape and that is horizontally provided; a plate-like upright portion 82*b*' standing upright on one end of the horizontal member 82*a*'; a plate-like upright portion 82*c*' standing upright on the other end of the horizontal member 82*a*'. The horizontal member 82*a*' has a plate-like member 82*a*-1' assuming the shape of an elongated rectangular plate and a rail portion 82*a*-2' laid, along its longitudinal direction, on the upper surface of the plate-like member 82*a*-1' in parallel with the ball screw 86'. Even when the front-back direction actuation blocks are configured in the same way as the front-back direction actuation blocks 70' shown in FIG. 12, working effects and advantages similar to those yielded by the front-back direction actuation blocks 70 shown in FIG. 5 can also be yielded.

Figure 11:
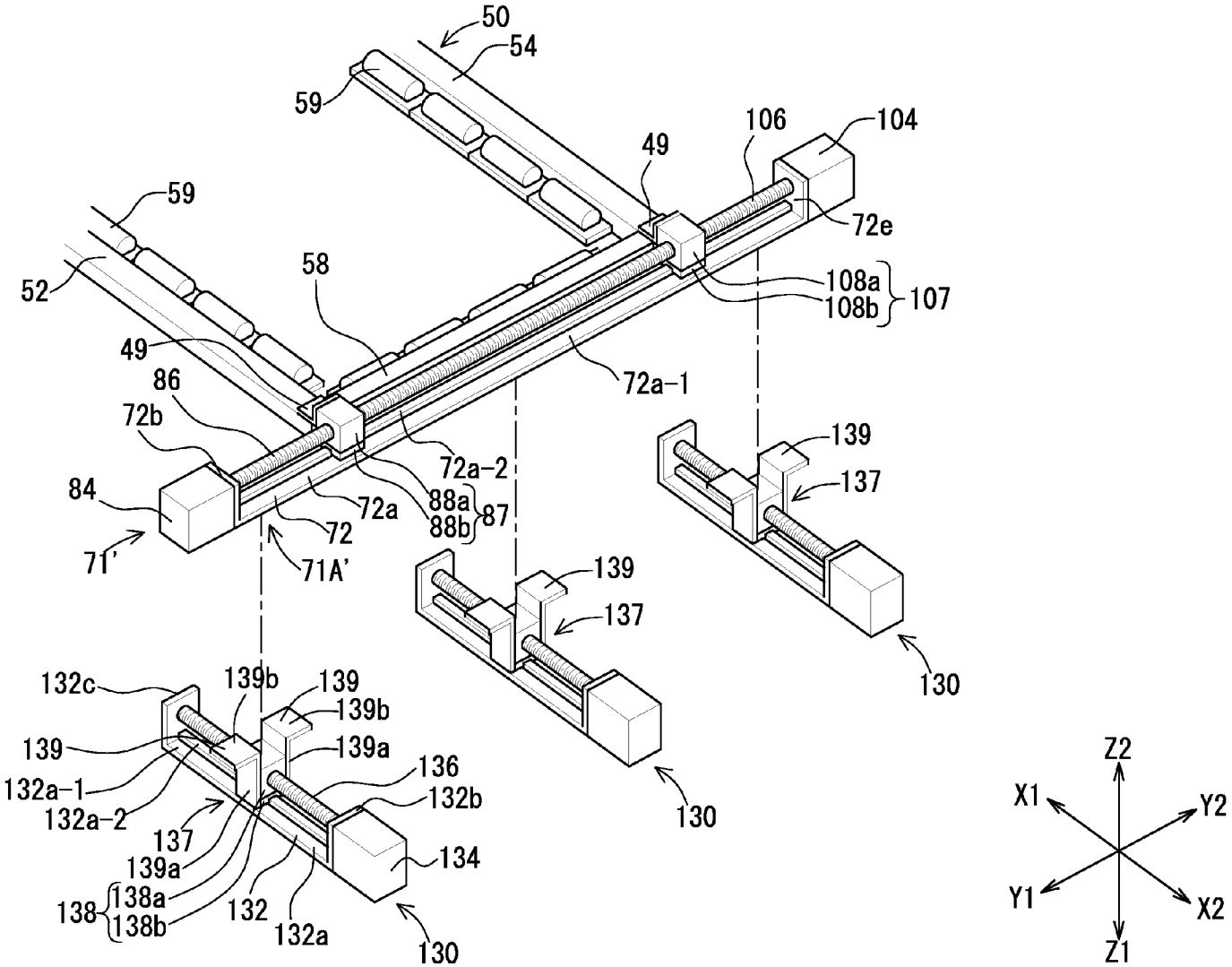
FIG. 11 It is an exploded perspective view of a principal block of a sewing machine of another embodiment of the present invention.

Each of front-back direction actuation blocks 71' shown in FIG. 11 includes the bracket 72; the motor 84 disposed at one end (the upright portion 72*b*) of the bracket 72; the motor 104 disposed at the other end (the upright portion 72*e*) of the bracket 72; the ball screw 86 that is rotatively supported by the bracket 72, that is at one end connected to the motor 84 and at the other end connected to the motor 104, and that is rotated by the motors 84 and 104; and the movable members 87 and 107 screw-engaged with the ball screw 86 so as to become screwable as the ball screw 86 rotates. The bracket 72 has the horizontal member 72*a* that assumes an elongated rectangular substantially-plate-like shape and that is horizontally provided; the plate-like upright portion 72*b* standing upright on one end of the horizontal member 72*a*; the plate-like upright portion 72*e* standing upright on the other end of the horizontal member 72*a*. The horizontal member 72*a* has the plate-like member 72*a*-1 assuming the shape of an elongated rectangular plate; and the rail portion 72*a*-2 laid on the upper surface of the plate-like portion 72*a*-1 and along the longitudinal direction in parallel with the ball screw 86. Even when the front-back direction actuation blocks are configured in the same way as the front-back direction actuation blocks 71' shown in FIG. 11, working effects and advantages similar to those yielded by the front-back direction actuation blocks 71 shown in FIG. 4 can also be yielded.

The configuration of each of the front-back direction actuation blocks 70' except the motors 84 and 104 and the movable members 87 and 107 makes up a support that supports the first actuation block (the motors 84 and 104) and that supports the first movable member and the second movable member so as to be movable in the front-back direction. The configuration (the bracket 82' and the ball screw 86') of each of the front-back 2Q direction actuation blocks 71' except the motors 84 and 104 and the movable members 87 and 107 makes up a support 71A' that supports the second actuation block (the motors 84 and 104) and that supports the third movable member (the movable member 87) and the fourth movable member (the movable member 107) so as to be movable in the front-back direction. In the embodiments shown in FIGS. 2 and 5, each of the front-back direction actuation blocks 70 is provided with the two brackets 82 and 102. However, as shown in FIG. 12, each of the front-back direction actuation blocks 70 can also be configured so as to include one bracket.

In the above configuration, a single front-back direction actuation block 70 and a single front-back direction actuation block 71 each is provided with the two motors 84 and 104. One motor can also be provided for either end of the single front-back direction actuation block. Even in such a case, the front-back direction actuation blocks can actuate the sewing frame 50 in the front-back direction. However, when one motor is provided for either end of the single front-back direction actuation block, torque is given to the end of the ball screw connected to the motor in the shaft-shaped member or the ball screw that is built, by and large, from one ball screw, whereupon the shaft-shaped member (or the ball screw) rotates. Since the end of the ball screw opposite to its end connected to the motor is driven in a following manner, slight torsion occurs in the shaft-shaped member (or the ball screw). For this reason, there may arise a case where a slight lag will arise in response movement of the movable member situated at an opposite position on the shaft-shaped member with respect to its end connected to the motor. In this sense, it is preferable to provide motors at both ends of one front-back direction actuation block 70 as mentioned above.

In the above descriptions, the front-back direction actuation blocks 70 have been described as being provided in number of two, and the right-left direction actuation blocks 130 have also been described as being provided in number of three on either side of the table along its right-left direction. However, the essential requirement for the front-back direction actuation block 70 is to be provided in number of one or more (in number of three or more is also acceptable), and the essential requirement for the right-left direction actuation blocks 130 is to be provided in number of two or more.

In the sewing machine 5 of the present embodiment, the ball screw mechanisms have been described as being used for the front-back direction actuation blocks and the right-left direction actuation blocks that make up the sewing frame actuation block 60. However, the actuation blocks are not limited to the ball screw mechanisms. Timing belt mechanisms can also be used.

Figure 13:
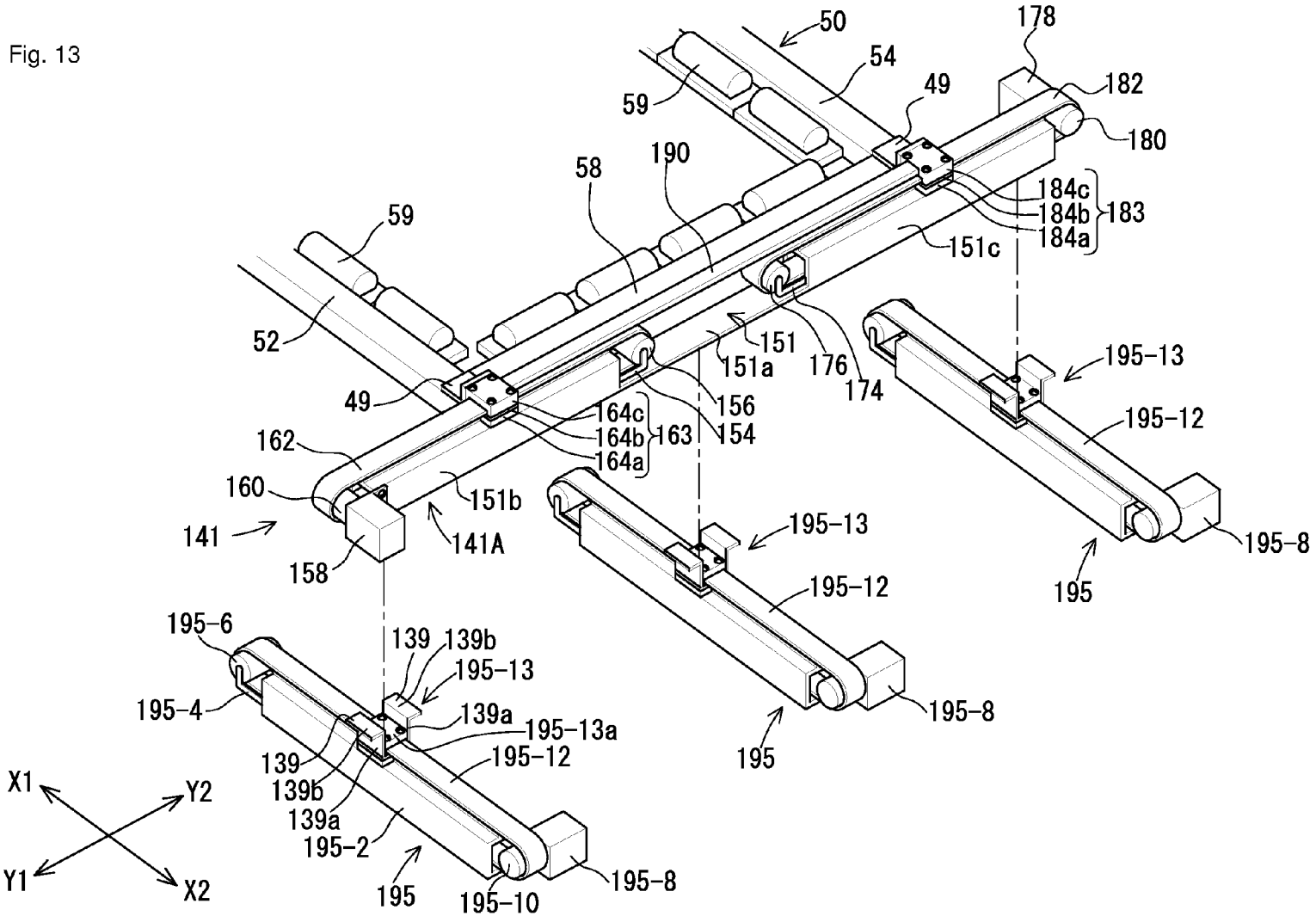
FIG. 13 It is a perspective view of a principal block of another example sewing frame actuation block; namely, a perspective view of a principal block achieved when a timing belt mechanism is used.
Figure 14:
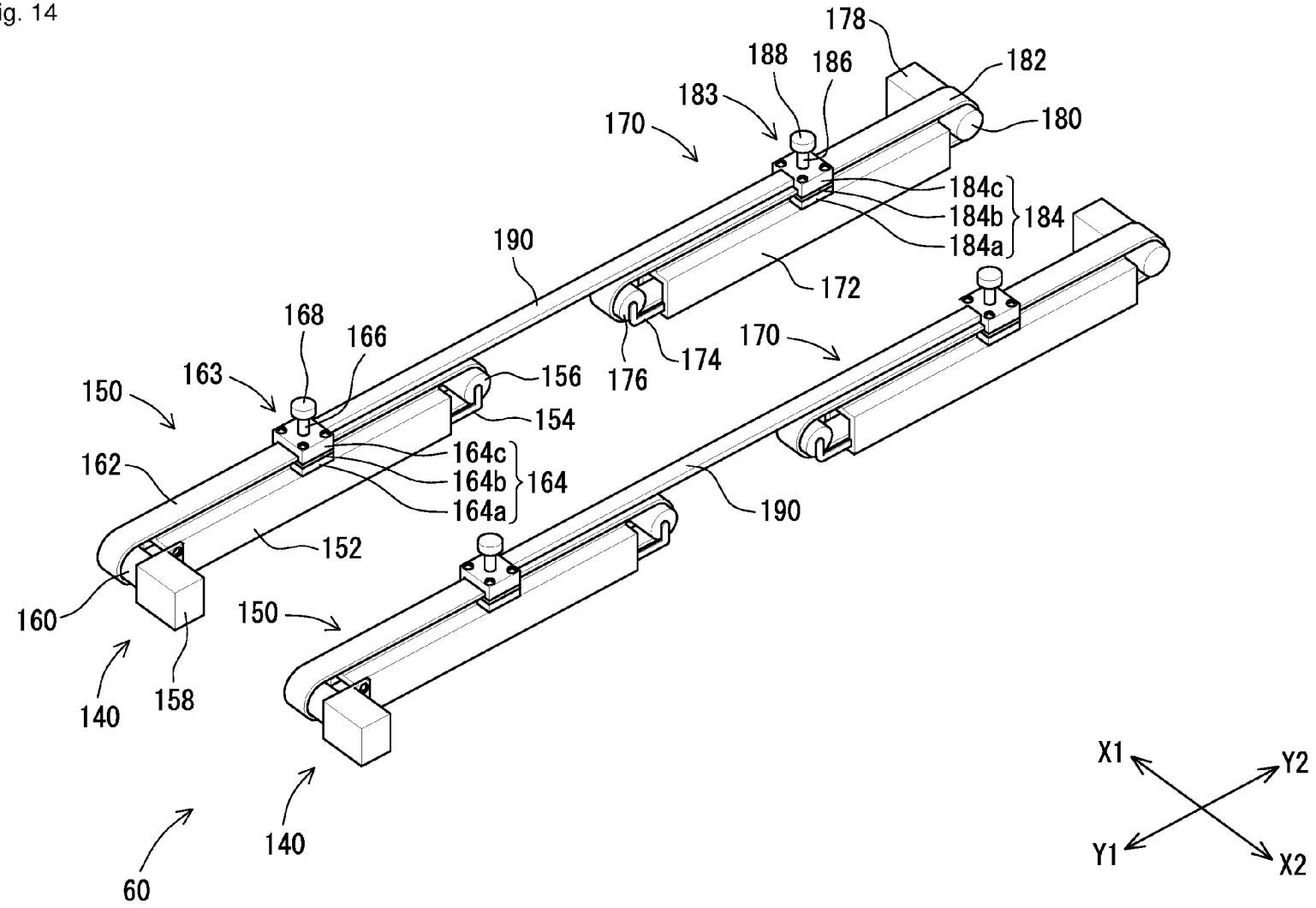
FIG. 14 It is a perspective view of a principal block of another example sewing frame actuation block; namely, a perspective view of a principal block achieved when a timing belt mechanism is used.
Figure 15:
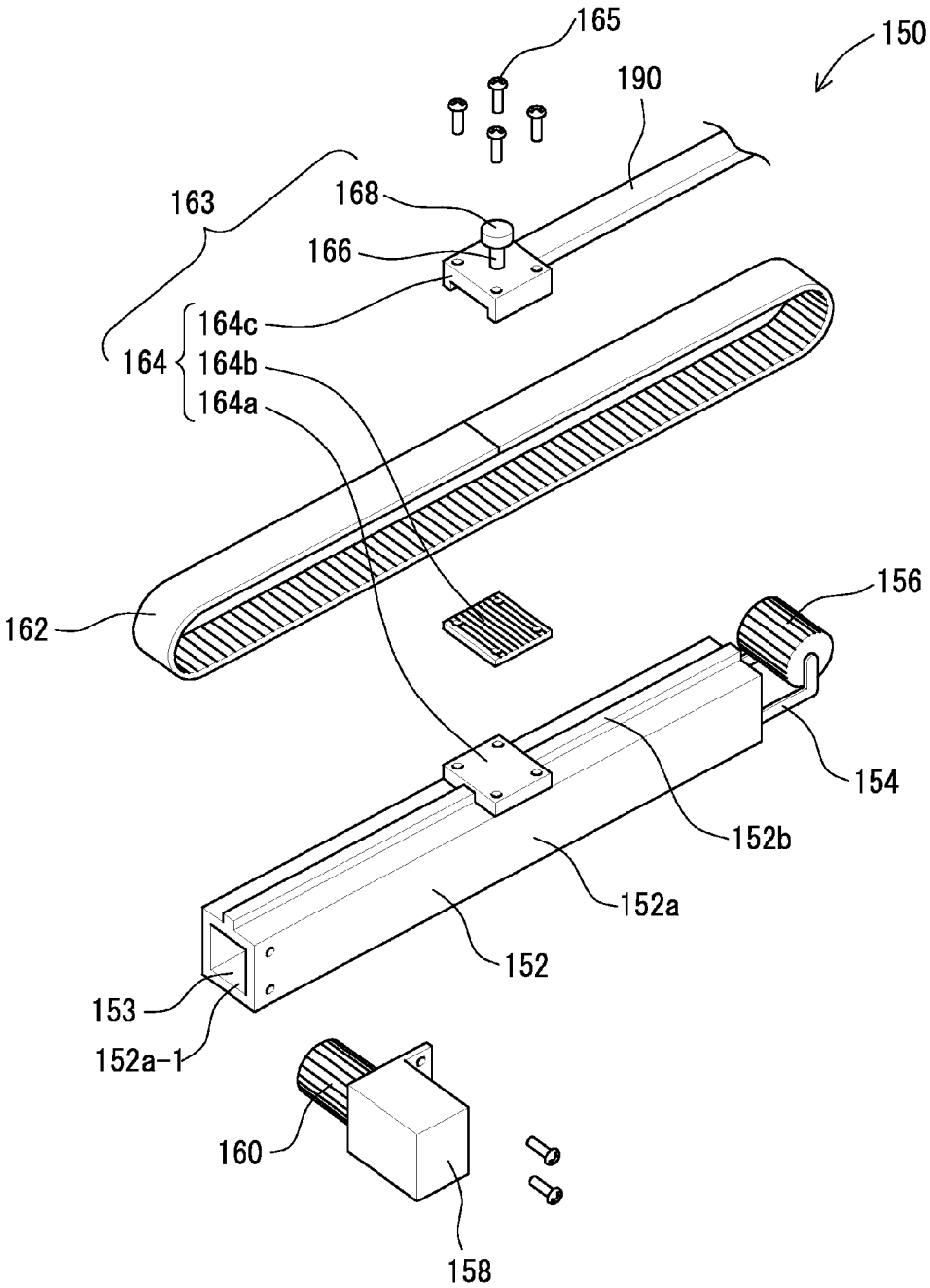
FIG. 15 It is an exploded perspective view of a timing belt mechanism block.

Specifically, in the sewing frame actuation block 60 of the sewing machine 5 of the present embodiment, front-back direction actuation blocks 140 (first front-back direction actuation blocks) shown in FIGS. 14 and 15 are used in place of the front-back direction actuation blocks 70. Further, front-back direction actuation blocks 141 (second front-back direction actuation blocks) shown in FIG. 13 are used in place of the front-back direction actuation blocks 71. Moreover, right-left direction actuation blocks 195 shown in FIG. 13 are used in place of the right-left direction actuation blocks 130.

As shown in FIG. 14, each of the front-back direction actuation blocks 140 includes timing belt mechanism blocks 150 and 170 and a joint member 190.

Each of the timing belt mechanism blocks 150 includes a substantially sleeve-shaped frame (a support frame) 152 attached to the upper surface of the bed 20; a support 154 attached to one end of the frame 152; a rotary pulley 156 rotatively attached to the support 154; a motor 158 (a first motor) attached to a side surface of the other end of the frame 152; a rotary pulley 160 attached to an output end of the motor 158; an endless timing belt 162 (a first timing belt); and a movable member 163 (a first movable member) that is fixedly attached to the timing belt 162 and that makes sliding action along a rail portion 152*b* of the frame 152.

As shown in FIGS. 13 and 14, the frame 152 includes a frame body 152*a* that assumes the shape of a square sleeve and has an insert hole 153 formed in the frame body; and the rail portion 152*b* laid at a center portion of an upper surface of the frame body 152*a* along its longitudinal direction. The frame 152 is placed along the front-back direction. The support 154 is provided as a pair. The supports 154 are disposed at a rear position (in the Y2 direction) with respect to rear ends of both sidewalls of the frame body 152*a*. The supports 154 are formed from substantially-L-shaped members and can axially, rotatively support the rotary pulley 156. The rotary pulley 156 is provided so as to be rotative with respect to the support 154 and also rotatable by way of an axial line orthogonal to the longitudinal direction of the frame 152 [i.e., the right-left direction (the X1-X2 direction)].

The motor 158 has a flange that can be attached to a side surface of the frame body 152*a*. A direction of a rotary shaft of the motor is orthogonal to the longitudinal direction of the frame 152. The rotary pulley 160 that is rotated by the motor 158 is also rotatable by way of an axial line orthogonal to the longitudinal direction of the frame 152 (i.e., the right-left direction). Cogs to engage with the timing belt 162 are formed on a peripheral surface of the rotary pulley 156 and a peripheral surface of the rotary pulley 160.

One end of the timing belt 162 is passed around the rotary pulley 156, and the other end of the same is passed around the rotary pulley 160. An upper side of the timing belt is situated above the frame 152. Further, a lower side of the timing belt is situated in the insert hole 153 of the frame 152. In reality, the timing belt 162 is in the form of an endless belt formed by bringing both ends of a band-like belt into contact with each other. The timing belt is configured by inserting the belt into the insert hole 153 and fixedly nipping both ends of the thus-inserted belt by use of a belt nip plate 164*b* and a fixture 164*c* while both of the ends of the belt remain in contact with each other (contacted portions of both ends of the belt are at this time situated between the belt nip plate 164*b* and the fixture 164*c*). Cogs are formed on an interior side of the timing belt 162.

The movable member 163 has a movable member body 164, a shaft portion 166, and an engagement roller 168. The movable member body 164 has a substantially plate-like slider 164*a*, the belt nip plate 164*b*, and the fixture 164*c*. A groove to engage the rail portion 152*b* is formed in a lower surface of the slider 164*a*, and the slider 164*a* also slides along the rail portion 152*b*. The belt nip plate 164*b* assumes a substantially plate-like shape, and cogs to engage the cogs provided on an inner side of the timing belt 162 are formed on an upper surface of the belt nip plate 164*b*. A shallow groove in which the timing belt 162 is to be placed is formed in a lower surface of the fixture 164*c*. The fixture 164*c* nips the timing belt 162 along with the belt nip plate 164*b*, thereby fixing the timing belt. While the timing belt 162 is sandwiched between the fixture 164*c* and the belt nip plate 164*b*, the belt nip plate 164*b* is superimposed on an upper surface of the slider 164*a*. In this state, the slider, the belt nip plate, and the fixture are integrally secured with screws 165, whereby the movable member body 164 is formed. Holes used for insertion of the screws 165 are opened at four corners of the fixture 164*c* and four corners of the belt nip plate 164*b*. Screw holes by way of which the screws 165 are secured are opened at four corners of the slider 164*a*.

The shaft portion 166 is fixedly attached to an upper surface of the fixture 164*c* and inserted into the cutout 34*a* of the table 30 and the slit of the slit plate 38 with play; namely, allowance, to thus protrude from the upper surface of the table 30. The engagement roller 168 is axially attached to the shaft portion 166 so as to become rotatable and situated at an elevated position above the upper surface of the table 30.

The timing belt mechanism block 170 is structurally analogous to the timing belt mechanism block 150 and; hence, its detailed explanations are omitted here for brevity. Specifically, the timing belt mechanism block 170 has a substantially sleeve-shaped frame block (a support frame) 172 attached to the upper surface of the bed 20; a support 174 attached to one end of the frame 172; a rotary pulley 176 attached to the support 174 in a rotatable fashion; a motor 178 (a second motor) attached to a side surface of the other end of the frame 172; a rotary pulley 180 attached to an output end of the motor 178; an endless timing belt 182 (a second timing belt); and a movable member 183 (a second movable member) that is fixedly attached to the timing belt 182 and that slides along a rail portion of the frame 172.

The frame 172, the support 174, the rotary pulley 176, the motor 178, the rotary pulley 180, the timing belt 182, and the movable member 183 are structurally analogous to respective portions of the timing belt mechanism block 150; namely, the frame 152, the support 154, the rotary pulley 156, the motor 158, the rotary pulley 160, the timing belt 162, and the movable member 163.

Specifically, the movable member 183 has a movable member body 184, a shaft portion 186, and an engagement roller 188. The movable member body 184 has a slider 184*a* that is structurally same to the slider 164*a*, a belt nip plate 184*b* that is structurally same to the belt nip plate 164*b*, and a fixture 184*c* that is structurally same to the fixture 164*c*. While the timing belt 182 is sandwiched between the fixture 184*c* and the belt nip plate 184*b*, the belt nip plate 184*b* is superimposed on an upper surface of the slider 184*a* and integrally secured with screws, whereby the movable member body 184 is formed. The shaft portion 186 is structurally same to the shaft portion 166, and the engagement roller 188 is structurally same to the engagement roller 168. The movable member 183 is spaced apart from the movable member 163. The motor 158 and the motor 178 belonging to each of the front-back direction actuation blocks 140 make up the first actuation block referred to in the claims.

The joint member 190 assumes a substantially rod-like shape and is fixedly interposed between the movable member 163 and the movable member 183. One end of the joint member 190 is fixed to the fixture 164*c* of the movable member 163, and the other end of the same is fixed to the fixture 184*c* of the movable member 183. The joint member 190 of each of the front-back direction actuation blocks 140 corresponds to "first space holding means" referred to in the claims. The configuration of each of the front-back direction actuation blocks 140 except the motors 158 and 178 and the movable members 163 and 183 acts as a support that supports a first actuation block (the motors 158 and 178) and also supports the first movable member (the movable member 163) and the second movable member (the movable member 183) so as to be movable in the front-back direction. In the timing belt mechanism block 150, the frame 152, the support 154, and the rotary pulleys 156 and 160 serve as a support that supports the first actuation block (the motor 158) and also supports the first movable member so as to be movable in the front-back direction. In the timing belt mechanism block 170, the frame 172, the support 174, and the rotary pulleys 176 and 180 serve as a support that supports the first actuation block (the motor 178) and also supports the second movable member so as to be movable in the front-back direction.

In each of the front-back direction actuation blocks 140, the timing belt 162 of the timing belt mechanism block 150 and the timing belt 182 of the timing belt mechanism block 170 are aligned to each other along the front-back direction. The movement path of the movable member 163 that is made up of upper part of the timing belt 162, lies in the extension of the movement path of the movable member 183 that is made up of upper part of the timing belt 182. The joint member 190 is set in alignment with the direction (front-back direction) of the timing belts 162 and 182.

The plurality of front-back direction actuation blocks 140 are aligned in parallel with each other in the front-back direction. In the plurality of front-back direction actuation blocks 140, the movable members 163 and 183 are configured so as to move in parallel with each other. The plurality of front-back direction actuation blocks 140 are structurally equal to each other in terms of a configuration.

The front-back direction actuation blocks 141 used in place of the front-back direction actuation blocks 71 are structurally, substantially same to the front-back direction actuation blocks 140 in FIGS. 14 and 15. As shown in FIG. 13, the frame 152 and the frame 172 are integrally configured. The shaft portion 166 and the engagement roller 168 are removed from the movable member 163, and the shaft portion 186 and the engagement roller 188 are removed from the movable member 183.

A bottom portion 152*a*-1 (see FIG. 15) making up a bottom surface of the square sleeve-like frame body 152*a* in the frame 152 and a bottom surface making up a bottom surface of a square sleeve-like frame body in the frame 172 are formed from one plate-like portion. As a result, the frame 152 and the frame 172 are integrally formed. Specifically, as shown in FIG. 13, a frame (a support frame) 151 has an elongated rectangular plate-like portion 151*a*; a frame makeup portion 151*b* that is placed in one area (in a vicinity of Y1) of the plate-like portion 151*a* in its front-back direction and that assumes a substantially C-shaped cross sectional profile (equal to a configuration obtained by removal of the bottom portion 152*a*-1 from the frame 152 shown in FIG. 15); and a frame makeup portion 151*c* that is placed in the other area (in a vicinity of Y2) of the plate-like portion 151*a* in its front-back direction and that assumes a substantially C-shaped cross sectional profile (structurally identical with the frame makeup portion 151-*b*). The plate-like portion 151*a* assumes a length equal to a distance from one end of the frame makeup portion 151*b* to the other end of the frame makeup portion 151*c*.

The movable member 163 of the front-back direction actuation block 141 is built from the slider 164*a*, the belt nip plate 164*b*, and the fixture 164*c* (i.e., the movable member 163 corresponds to the movable member body 164 in the timing belt mechanism block 150). The connection members 49 are attached to respective side surfaces of the movable members 163 (in particular, the side surfaces of the fixtures 164*c* of the movable members 163) facing the sewing frame 50. The movable members 163 are secured to the respective short sides 56 and 58 of the sewing frame 50 by way of the connection members 49. Specifically, the vertical members 49*b* of the respective connection members 49 are secured to the movable members 163 (in particular, the fixtures 164*c* of the movable members 163). Further, the horizontal members 49*a* are fixed to the short sides 56 and 58 of the sewing frame 50, whereby the movable members 163 and the sewing frame 50 are connected to each other. Likewise, the movable member 183 is built from the slider 184*a*, the belt nip plate 184*b*, and the fixture 184*c* (i.e., the movable member 183 corresponds to the movable member body 184 of the timing belt mechanism block 170). The connection members 49 are attached to side surfaces of each of the movable members 183 (in particular, side surfaces of the fixture 184*c* of each of the movable members 183) facing the sewing frame 50, and the movable members 183 are fixed to the short sides 56 and 58 of the sewing frame 50 by way of the connection members 49. Specifically, the vertical members 49*b* of the respective connection members 49 are secured to the respective movable members 183 (in particular, the fixtures 184*c* of the respective movable members 183). Further, the horizontal members 49*a* are fixed to the short sides 56 and 58 of the sewing frame 50, whereby the movable members 183 and the sewing frame 50 are connected together. As mentioned above, the front-back direction actuation blocks 141 are placed substantially flush with the sewing frame 50 in much the same way as the front-back direction actuation blocks 71. In FIG. 13, the connection members 49 are connected to corners of the sewing frame 50 (namely, areas where the short sides and the corresponding long sides abut each other). However, when thought is given to the fact that both the short sides 56 and 58 and the long sides 52 and 54 include the corners, the connection members 49 can be said to be attached to longitudinal ends of the respective long sides 52 and 54. The connection members 49 can also be attached to areas on the short sides 56 and 58 other than the corners of the sewing frame 50. Moreover, the long sides 52 and 54 can also be made longer, in the right-left direction, than respective ends of the short sides 56 and 58, and the connection members 49 can be attached to longitudinal ends of the long sides 52 and 54. As above, one front-back direction actuation block 141 is placed outside the lateral side of the sewing frame 50 along the short side 56, and the movable members 163 and 183 of the front-back direction actuation block 141 are connected to the sewing frame 50 by way of the connection members 49. Further, the other front-back direction actuation block 141 is placed outside the lateral side of the sewing frame 50 along the short side 58. The movable members 163 and 183 of the other front-back direction actuation block 141 are connected to the sewing frame 50 by way of the connection members 49. In one of the front-back direction actuation blocks 141, the movable member 163 and the movable member 183 are spaced apart from each other. In each of the front-back direction actuation blocks 140 and 141, the movable members 163 and the 183 are provided so as to be movable in the front-back direction.

A configuration of each of the front-back direction actuation blocks 141 except the motors 158 and 178 and the movable members 163 and 183 (i.e., the frame 151, the supports 154 and 174, the rotary pulleys 156, 160, 176, and 180, the timing belts 162 and 182, and the joint member 190) makes up a "support 141A that supports a second actuation block (the motors 158 and 178) and also supports a third movable member (the movable member 163) and a fourth movable member (the movable member 183) so as to be movable in the front-back direction". The timing belt 162 of the front-back direction actuation block 141 corresponds to a third timing belt, and the timing belt 182 of the front-back direction actuation block 141 corresponds to a fourth timing belt. Further, the motor 158 of the front-back direction actuation block 141 corresponds to a third motor, and the motor 178 of the front-back direction actuation block 141 corresponds to a fourth motor. The movable member 163 of the front-back direction actuation block 141 corresponds to the third movable member, and the movable member 183 of the front-back direction actuation block 141 corresponds to the fourth movable member. The frame 151, the support 154, the rotary pulley 156, the rotary pulley 160, the support 174, the rotary pulley 176, and the rotary pulley 180 make up a "support that supports the third motor and the fourth motor and also supports the third timing belt and the fourth timing belt in a revolving manner". The motors 158 and 178 of the front-back direction actuation block 141 make up the second actuation block referred to in the claims. The joint member 190 in each of the front-back direction actuation blocks 141 corresponds to the "second space holding means" referred to in the claims.

The right-left direction actuation blocks 195 used in place of the right-left direction actuation blocks 130 are substantially similar, in structure, to the timing belt mechanism blocks 150 shown in FIG. 14. Each of the right-left direction actuation blocks 195 is embodied by removal of the shaft portion and the engagement roller from the configuration of the movable member 163 shown in FIG. 14 and addition of the support member 139 provided in the movable member 137 of the right-left direction actuation block 130 shown in FIG. 4. The respective right-left direction actuation blocks 195 assume the same configuration.

Specifically, each of the right-left direction actuation blocks 195 includes a substantially sleeve-shaped frame 195-2 attached to the upper surface of the bed 20; a support 195-4 attached to one end of the frame 195-2; a rotary pulley 195-6 rotatively attached to the support 195-4; a motor 195-8 (a third actuation block) attached to a side surface of the other end of the frame 195-2; a rotary pulley 195-10 attached to an output end of the motor 195-8; an endless timing belt 195-12 (a third timing belt); and a movable member 195-13 (a third movable member) that is fixedly secured to the timing belt 195-12 and that slides along a rail of the frame 195-2.

The frame 195-2, the support 195-4, the rotary pulley 195-6, the motor 195-8, the rotary pulley 195-10, and the timing belt 195-12 are structurally same to their counterparts of the timing belt mechanism block 150; namely, the frame 152, the support 154, the rotary pulley 156, the motor 158, the rotary pulley 160, and the timing belt 162.

The pair of right-left direction actuation blocks 195 corresponding to the pair of openings (the pair consisting of the opening 36*a* and the opening 36*b*) are placed so as to oppose each other. In the mutually-opposed right-left direction actuation blocks 195, one timing belt 195-12 is configured so as to lie in an extension of the other timing belt 195-12. The right-left direction actuation block 195 is provided in number of three on either side of the table along its right-left direction. The three right-left direction actuation blocks 195 are placed in parallel with each other. In the three right-left direction actuation blocks 195, the movable members 195-13 are configured so as to move in parallel with each other.

Each of the movable members 195-13 is made up of a movable member body 195-13*a* and the pair of support members 139. Specifically, the vertical members 139*a* of the respective L-shaped plate-like support members 139 are attached to both sides of the movable member body 195-13*a*. The movable member body 195-13*a* is structurally same to the movable member 163 in the front-back direction actuation block 141, and the vertical member 139*a* of the support member 139 is attached to either side of the movable member body 195-13*a* [in particular, either side of a fixture (the fixture structurally same to the fixture 164*c*)]. The horizontal members 139*b* of the support members 139 are secured to a lower surface of the plate-like portion 151*a* of the front-back direction actuation block 141.

The movable member 195-13 of the right-left direction actuation block 195 corresponds to a fifth movable member. The timing belt 195-12 of the right-left direction actuation block 195 provided in correspondence with the opening 36*a*

(i.e., the right-left direction actuation block 195 disposed along the short side 56) corresponds to a fifth timing belt. Further, the timing belt 195-12 of the right-left direction actuation block 195 disposed in correspondence with the opening 36*b* (i.e., the right-left direction actuation block 195 disposed along the short side 58) corresponds to a sixth timing belt. Either the right-left direction actuation block 195 disposed in correspondence with the opening 36*a* or the right-left direction actuation block 195 disposed in correspondence with the opening 36*b* serves as a first right-left direction actuation block, and a remaining one serves as a second right-left direction actuation block. The motor 195-8 of the first right-left direction actuation block corresponds to a fifth motor, and the motor 195-8 of the second right-left direction actuation block corresponds to a sixth motor. In the foregoing sixteenth configuration, the motor 195-8 of the right-left direction actuation block 195 corresponds to the fifth motor.

When viewed in plane, a direction of the timing belts 162 and 182 of the respective front-back direction actuation blocks 140 and 141 is oriented at right angles to a direction of the timing belts 195-12 of the respective right-left direction actuation blocks 195.

The engagement roller 168 of the timing belt mechanism block 150 in each of the front-back direction actuation blocks 140 engages with the groove M of the long side 52 of the sewing frame 50. The engagement roller 188 of the timing belt mechanism block 170 engages with the groove M of the long side 54 of the sewing frame 50.

Cogs formed on the inner side of each of the timing belts 162, 182, and 195-12 that make up the sewing frame actuation block 60 are formed at the same pitch.

As above, even when the timing belt mechanism is used, the front-back direction actuation block 140 is disposed in number of two on either side of the table along its front-back direction, and the right-left direction actuation block 195 is disposed in number of three on either side of the table along its right-left direction. When the front-back direction actuation blocks and the right-left direction actuation blocks of the sewing frame actuation block 60 are made up of timing belt mechanisms as shown in FIGS. 13 to 17, the sewing frame actuation block is identical with that mentioned previously except a difference in the configuration of front-back direction actuation blocks and right-left direction actuation blocks belonging to the sewing frame actuation block 60.

The control circuit 200 controls operation of the motors 158, 178, and 195-8 of the sewing frame actuation block 60. The control circuit 200 is connected to all of the motors in the sewing frame actuation block 60 and controls operation of the respective motors. Specifically, in relation to operation control of the motors 158 and 178 of the front-back direction actuation blocks 140 and 141, the control circuit 200 performs synchronous control of all of the motors 158 and 178 of the respective front-back direction actuation blocks 140 and 141. In particular, since the movable member 163 and the movable member 183 are joined together by means of the joint member 190, the motors 158 and 178 belonging to any one of the front-back direction actuation blocks 140 and 141 are synchronously controlled. The respective motors 158 in the plurality of front-back direction actuation blocks 140 and the plurality of front-back direction actuation blocks 141 are also synchronously controlled. Likewise, the respective motors 178 in the plurality of front-back direction actuation blocks 140 and the plurality of front-back direction actuation blocks 141 are synchronously controlled. Since the movable member 163 and the movable member 183 are joined together by means of the joint member 190 (see FIG. 14), the motors 158 and 178 belonging to any one of the front-back direction actuation blocks 140 and 141 are controlled so as to rotate in opposite directions. Specifically, in each of the front-back direction actuation blocks 140, the motor 158 of the timing belt mechanism block 150 that actuates the long side 52 and the motor 178 of the timing belt mechanism block 170 that actuates the long side 54 are controlled so as to rotate in opposite directions. Likewise, in each of the front-back direction actuation blocks 141, the motor 158 and the motor 178 are controlled so as to rotate in opposite directions. As mentioned above, operation of the motors 158 and 178 are controlled in such a way that the movable members 163 and 183 belonging to all of the plurality of front-back direction actuation blocks 140 and 141 become equal to each other in terms of a direction of movement and a movement distance.

Even in relation to operation control of the motors 195-8 of the respective right-left direction actuation blocks 195, the control circuit 200 synchronously controls all of the motors of the right-left direction actuation blocks 195. Incidentally, the motors 195-8 of the right-left direction actuation blocks 195 that actuate the front-back direction actuation blocks 141 connected to the short side 56 and the motors 195-8 of the right-left direction actuation blocks 195 that actuate the front-back direction actuation blocks 141 connected to the short side 58 are controlled so as to rotate in opposite directions. Specifically, operation of the motors 195-8 is controlled in such a way that the movable members 195-13 of the respective right-left direction actuation blocks 195 become equal to each other in terms of a direction of movement and a movement distance.

In reality, the control circuit 200 has a storage device that stores programs for controlling operation of the motors, a CPU that controls the motors according to the programs stored in the storage device, and others.

An explanation is now given to operation of the sewing machine accomplished when the front-back direction actuation blocks and the right-left direction actuation blocks, which make up the sewing frame actuation block 60, are built from the timing belt mechanisms as shown in FIGS. 13 to 17. While the sewing frame 50 is being actuated in both the front-back direction and the right-left direction with processed fabric stretched across the sewing frame 50, the fabric is sewn by means of cooperative operation between a needle that is provided in the sewing head 22 and vertically actuated and the shuttle to be rotatively actuated. In order to stretch the processed fabric across the sewing frame 50, the fabric is nipped between the projection 59*b* and the cap 59*c*.

The sewing frame 50 is actuated in both the front-back direction and the right-left direction under control of the control circuit 200. Specifically, the motors 158 and 178 of the front-back direction actuation blocks 140 and 141 are operated under control of the control circuit 200. As the motors 158 and 178 are driven, the timing belts 162 and 182 revolve. As the timing belts 162 and 182 revolve, the movable members 163 and 183 move. Specifically, the movable members 163 and 183 move in the front-back direction. Moreover, under control of the control circuit 200, the motors 195-8 in the respective front-back direction actuation blocks 195 are operated. As the motors 195-8 are driven, the timing belts 195-12 revolve, whereupon the movable members 195-13 move in the right-left direction.

In each of the front-back direction actuation blocks 140, the engagement roller 168 engages with the long side 52 of the sewing frame 50, and the engagement roller 188 engages with the long side 54 of the sewing frame 50. Further, in each of the front-back direction actuation blocks 141, the movable members 163 and 183 are connected to the sewing frame 50 by way of the connection members 49. Hence, the sewing frame 50 moves in the front-back direction as the movable members 163 and 183 move. Furthermore, the movable member 195-13 in each of the right-left direction actuation blocks 195 is secured to the frame 151 of the corresponding front-back direction actuation block 141. Hence, as the movable members 195-13 move, the sewing frame 50 moves in the right-left direction.

Even when the front-back direction actuation blocks and the right-left direction actuation blocks that make up the sewing frame actuation block 60 are built from the timing belt mechanisms as shown in FIG. 13 and other drawings, all of the four sides of the sewing frame 50 are supported by the movable members (in other words; the pair consisting of the long sides 52 and 54 is supported by means of the movable members 163 and 183 of the respective front-back direction actuation blocks 140, and the pair consisting of the short sides 56 and 58 are supported by means of the movable members 163 and 183 of the respective front-back direction actuation blocks 141). Thus, since all of the sides of the sewing frame 50 are equipped with the drive mechanisms, distortion of the sewing frame 50 can be minimized, so that the sewing frame can be positioned with high accuracy.

All of the sides of the sewing frame are provided with the drive mechanisms and all of the sides of the sewing frame are actively positioned, thereby preventing distortion of the sewing frame, which would otherwise occur even when the processed fabric is pulled inside by means of tensile force of the processed fabric developing during sewing operation.

In particular, in each of the front-back direction actuation blocks 140 supporting the long sides 52 and 54 of the sewing frame 50 and each of the front-back direction actuation blocks 141 supporting the short sides 56 and 58 of the same, the movable members 163 and 183 are integrally formed by way of the joint member 190. Therefore, even when the movable members attempt to move against the force of the motors as a result of occurrence of distortion (in particular, inward distortion) in the sewing frame 50, the joint members 190 regulate movements of the movable members, so that the movable members will not move against the force of the motors. Namely, when processed fabric is pulled inside as the fabric is sewn, the long sides 52 and 54 of the sewing frame 50 are also pulled inside, and both the movable members 163 and 183 are pulled inside, too. Since the movable members 163 and 183 are secured to the joint member 190, they will not move inside. Accordingly, the potential of occurrence of distortion in the long sides 52 and 54 of the sewing frame 50 is extremely small.

In the present embodiment, the respective front-back direction actuation blocks 141 are connected to the short sides 56 and 58, and the respective front-back direction actuation blocks 141 are configured so as to be actuated in the right-left direction by means of the right-left direction actuation blocks 195. Occurrence of deflection of the short sides 56 and 58 can be prevented. Further, since occurrence of deflection of the short sides 56 and 58 can be prevented, occurrence of deflection of the long sides 52 and 54 can also be prevented. Specifically, consideration is given to a case where the front-back direction actuation blocks 141 are not provided; where the movable members 195-13 of the respective right-left direction actuation blocks 195 are structurally analogous to the movable members 163 of the respective front-back direction actuation blocks 140; and the engagement rollers engage with the short sides 56 and 58. In this case, longitudinal end areas of the sewing frame 50 (namely, the areas close to the short sides 56 and 58) are not supported by the front-back direction actuation blocks 140. Hence, when processed fabric is pulled inside as the fabric is sewn, the longitudinal end areas of the sewing frame 50 may be deflected inside with respect to the front-back direction. However, in the present embodiment, the front-back direction actuation blocks 141 are connected to the short sides 56 and 58, and the longitudinal end areas of the sewing frame 50 are supported by the front-back direction actuation blocks. Therefore, the longitudinal end areas of the sewing frame 50 will not be deflected in the front-back direction.

In the above descriptions, each of the front-back direction actuation blocks 140 and the front-back direction actuation blocks 141 is built from two timing belt mechanism blocks. However, each of the front-back direction actuation blocks can also be built from one timing belt mechanism block, and two movable members can be fixedly spaced apart from each other on the one timing belt (a timing belt for a second front-back direction actuation block). A joint member (a joint member having a configuration same to that of the joint member 190) can also be interposed between the two movable members. In this case, the number of motors used for actuating the timing belt comes to one. Alternatively, the motor can also be disposed on either side of the timing belt.

Figure 16:
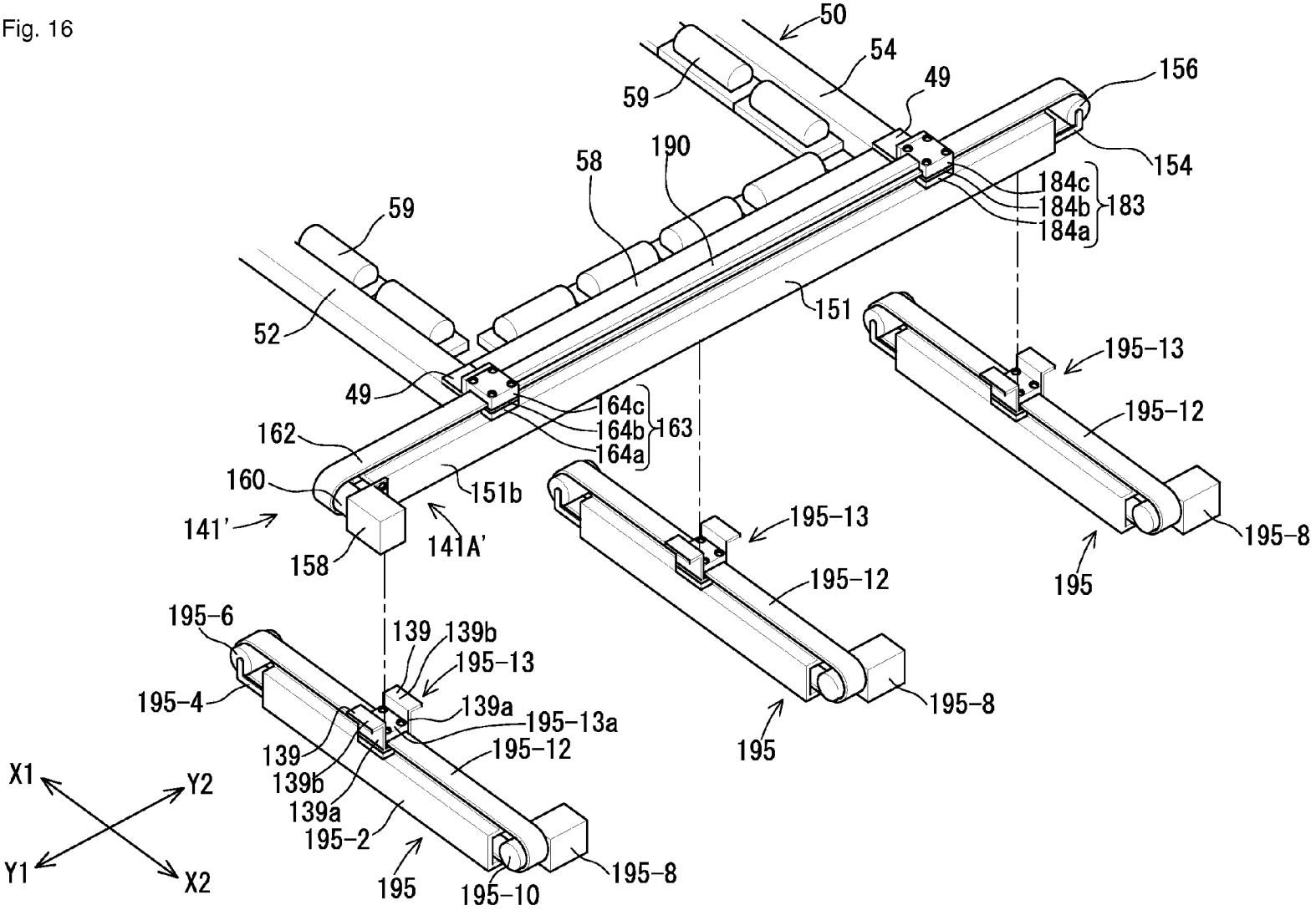
FIG. 16 It is a perspective view of a principal block of another example sewing frame actuation block; namely, a perspective view of a principal block achieved when a timing belt mechanism is used.

For instance, when each of the front-back direction actuation blocks 141 is built from one timing belt mechanism block, the front-back direction actuation block is configured as shown in FIG. 16. Specifically, each of front-back direction actuation blocks 141' has the substantially sleeve-shaped frame 151; the support 154 attached to one end of the frame 151; the rotary pulley 156 rotatively attached to the support 154; the motor 158 (the second actuation block) attached to a side surface of the other end of the frame 151; the rotary pulley 160 attached to an output end of the motor 158; the endless timing belt 162 (the timing belt for a second front-back direction actuation block); and the movable member 163 (the third movable member) and the movable member 183 (the fourth movable member) that are fixedly attached to the timing belt 162 and that slide along the rail portion of the frame 151. Specifically, the frame 151 has substantially the same length as that of the entire frame 151 in each of the front-back direction actuation blocks 141, and the entirety of the frame 151 is formed into a sleeve shape. Each of the front-back direction actuation blocks 141' is provided with one timing belt 162, and the movable member 163 and the movable member 183 are fixedly spaced apart from each other on the timing belt 162. Further, the substantially rod-like joint member 190 is fixed between the movable member 163 and the movable member 183. A configuration of each of the front-back direction actuation blocks 141' except the motor 158 and the movable members 163 and 183 (i.e., the frame 151, the support 154, the rotary pulleys 156 and 160, and the timing belt 162) makes up a "support 141A' that supports the second actuation block (the motor 158) and also supports the third movable member (the movable member 163) and the fourth movable member (the movable member 183) so as to be movable in the front-back direction."

Figure 17:
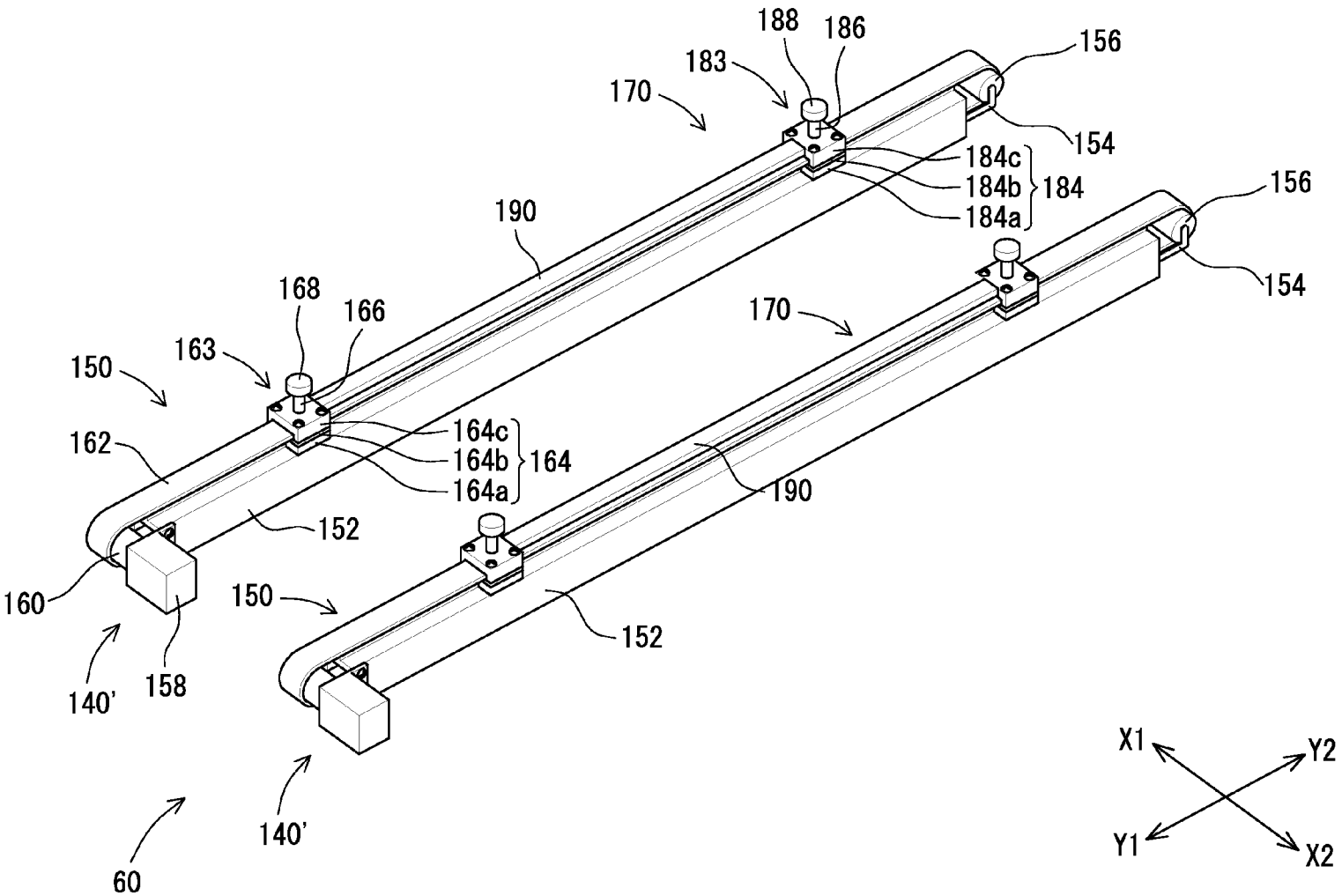
FIG. 17 It is a perspective view of a principal block of another example sewing frame actuation block.

For instance, when each of the front-back direction actuation blocks 140 is made up of one timing belt mechanism block, the actuation block is configured as shown in FIG. 17. Specifically, each of front-back direction actuation blocks 140' has the substantially sleeve-shaped frame 152; the support 154 attached to one end of the frame 152; the rotary pulley 156 rotatively attached to the support 154; the motor 158 (the first actuation block) attached to a side surface of the other end of the frame 152; the rotary pulley 160 attached to an output end of the motor 158; the endless timing belt 162 (a timing belt for a first front-back direction actuation block); and the movable member 163 (the first movable member) and the movable member 183 (the second movable member) that are fixedly attached to the timing belt 162 and that slide along the rail portion of the frame 152. Specifically, the frame 152 has substantially the same length as that of the entire frame 151 in each of the front-back direction actuation blocks 141, and the entirety of the frame 152 is formed into a sleeve shape. Each of the front-back direction actuation blocks 140' is provided with one timing belt 162, and the movable member 163 and the movable member 183 are fixedly spaced apart from each other on the timing belt 162. Further, the substantially rod-like joint member 190 is fixed between the movable member 163 and the movable member 183. A configuration of each of the front-back direction actuation blocks 140' except the motor 158 and the movable members 163 and 183 makes up a support that supports the first actuation block (the motor 158) and also supports the first movable member and the second movable member so as to be movable in the front-back direction. Each of the front-back direction actuation blocks 141' shown in FIG. 16 and each of the front-back direction actuation blocks 140' shown in FIG. 17 are provided with only one motor 158. However, another motor can also be put on a portion of the rotary pulley 156 facing the rotary pulley 156.

In the above descriptions, each of the front-back direction actuation blocks 70 is made up of the ball screw mechanism blocks 80 and 100, and each of the front-back direction actuation blocks 71 is made up of the ball screws 86 and 106. In this case, each of the right-left direction actuation blocks 130 is made up of the ball screw 136. However, each of the right-left direction actuation blocks can also be made up of the right-left direction actuation block 195 formed from the timing belt mechanism in lieu of the right-left direction actuation block 130. In the above descriptions, each of the front-back direction actuation blocks 140 is made up of the timing belt mechanism blocks 150 and 170, and each of the front-back direction actuation blocks 141 is made up of the timing belts 162 and 182. In this case, each of the right-left direction actuation blocks 195 is also made up of the timing belt 195-12. However, each of the right-left direction actuation blocks can also be made up of the right-left direction actuation block 130 (see FIG. 4) formed from the ball screw mechanism in lieu of the right-left direction actuation block 195.

In the above descriptions, the ball screws 86, 106, 136, 86', 286, 306, and 336 can also be given a designation "ball screw shaft" or a "ball screw spindle."

In the above descriptions, the front-back direction actuation block 140 has been described as being provided in number of two on either side of the table, and the right-left direction actuation block 195 has been described as being provided in number of three on either side of the table along its right-left direction. However, the essential requirement for the front-back direction actuation block 140 is to be provided in number of one or more (in number of three or more is also acceptable), and the essential requirement for the right-left direction actuation blocks 195 is to be provided in number of two or more.

DESCRIPTIONS OF THE REFERENCE NUMERALS AND SYMBOLS

5, SEWING MACHINE
10, 151, 152, 172, 195-2 FRAME
22 SEWING HEAD
30 TABLE
50 SEWING FRAME
51 SEWING FRAME BODY
52, 54 LONG SIDE
56, 58 SHORT SIDE
59 CLIP
60 SEWING FRAME ACTUATOR
70, 70', 71, 71', 140, 140', 141, 141' FRONT-BACK DIRECTION ACTUATION BLOCK
71A, 71A', 141A, 141A SUPPORT
80, 100 BALL SCREW MECHANISM BLOCK
72, 82, 82', 102, 132 BRACKET
84, 104, 134, 158, 178, 195-8 MOTOR
87, 107, 137, 163, 183, 195-13 MOVABLE MEMBER
88, 108, 139 NUT
92, 112, 168, 188 ENGAGEMENT ROLLER
124, 190 JOINT MEMBER
130, 195 RIGHT-LEFT DIRECTION ACTUATION BLOCK
139 SUPPORT MEMBER
150, 170 TIMING BELT MECHANISM BLOCK
164, 184, 195-13*a* MOVABLE MEMBER BODY
200 CONTROL CIRCUIT

The invention claimed is:

1. A sewing frame actuator for a sewing machine which actuates a sewing frame which is a square frame for stretching processed fabric to be sewn with a sewing machine and that comprises a pair of long sides and a pair of short sides, the actuator comprising:

a sewing frame actuation block for actuating the sewing frame in a front-back direction and a right-left direction which includes:

first front-back direction actuation blocks which actuate the sewing frame in a front-back direction;

second front-back direction actuation blocks which actuate the sewing frame in a front-back direction; and right-left direction actuation blocks which actuate the sewing frame in the right-left direction, wherein each of the first front-back direction actuation blocks includes a first movable member that comprises an engagement member to engage one long side of the sewing frame and that is placed so as to be movable in the front-back direction, a second movable member that comprises an engagement member to engage a remaining long side and that is placed so as to be movable in the front-back direction, and a first actuation block that moves the first movable member and the second movable member in the front-back direction;

each of the second front-back direction actuation blocks is laid along the pair of short sides of the sewing frame, and includes a third movable member that is connected to the short side or a longitudinal end of one long side of the sewing frame by a connection member, a fourth movable member that is connected to the short side or a longitudinal end of a remaining long side of the sewing frame by a connection member and that is spaced apart from the third movable member, a second actuation block that move the third movable member and the fourth movable member in the front-back direction, and a support that supports the second actuation block and also supports the third movable member and the fourth movable member so as to be movable in the front-back direction; and each of the right-left direction actuation blocks is provided in correspondence with each of the pair of short sides of the sewing frame, and includes a fifth movable member that is provided so as to be movable in a right-left direction and to hold the support, and a third actuation block that actuates the fifth movable member in the right-left direction; and wherein the first actuation block and the second actuation block are controlled synchronously by a control circuit in such a way that the first movable member and the second movable member move in an identical direction; and that the third movable member and the fourth movable member move in the same direction where the first movable member moves, and wherein the third actuation block on one short side of the sewing frame and the third actuation block on the other short side of the sewing frame are controlled synchronously by the control circuit in such a way that the fifth movable member on the one short side and the fifth movable member on the other short side move in an identical direction.

2. The sewing frame actuator for a sewing machine according to claim 1, wherein each of the first front-back direction actuation blocks comprises first space holding means maintaining constant spacing between the first movable member and the second movable member, and each of the second front-back direction actuation blocks comprises second space holding means maintaining constant spacing between the third movable member and the fourth movable member.

3. The sewing frame actuator for a sewing machine according to claim 2, wherein each of the first front-back direction actuation blocks comprises a ball screw as the first space holding means lying in a rotatable manner along the front-back direction, the first movable member and the second movable member are screw-engaged with the ball screw, and the first actuation block rotates the ball screw whereby the first movable member and the second movable member move in the front-back direction.

4. The sewing frame actuator for a sewing machine according to claim 3, wherein, in each of the first front-back direction actuation blocks, the ball screw comprises:

a first ball screw provided in a rotatable manner along the front-back direction, a second ball screw provided in a rotatable manner concentrically with the first ball screw along the front-back direction, and a joint member joining an end of the first ball screw facing the second ball screw to an end of the second ball screw facing the first ball screw;

wherein the first movable member is screw-engaged with the first ball screw, and the second movable member is screw-engaged with the second ball screw; and wherein the first actuation block comprises a first motor rotating the first ball screw and a second motor connected to an opposite end of the second ball screw with respect to an end thereof facing the first ball screw and that rotates the second ball screw.

5. The sewing frame actuator for a sewing machine according to claim 3, wherein the support comprises a ball screw lying as the second space holding means in a rotatable manner along the front-back direction, the third movable member and the fourth movable member are screw-engaged with the ball screw, and the second actuation block rotates the ball screw, whereby the third movable member and the fourth movable member move in the front-back direction.

6. The sewing frame actuator for a sewing machine according to claim 2, wherein the support comprises a ball screw lying as the second space holding means in a rotatable manner along the front-back direction, the third movable member and the fourth movable member are screw-engaged with the ball screw, and the second actuation block rotates the ball screw whereby the third movable member and the fourth movable member move in the front-back direction.

7. The sewing frame actuator for a sewing machine according to claim 6, wherein, in each of the second front-back direction actuation blocks, the ball screw comprises:

a third ball screw provided in a rotatable manner along the front-back direction, a fourth ball screw provided concentrically with the third ball screw in a rotatable manner along the front-back direction; and a joint member joining an end of the third ball screw facing the fourth ball screw to an end of the fourth ball screw facing the third ball screw;

wherein the third movable member is screw-engaged with the third ball screw, and the fourth movable member is screw-engaged with the fourth ball screw; and wherein the second actuation block comprises a third motor rotating the third ball screw and a fourth motor connected to an opposite end of the fourth ball screw with respect to an end thereof facing the third ball screw and that rotates the fourth ball screw.

8. The sewing frame actuator for a sewing machine according to claim 2, wherein each of the first front-back direction actuation blocks comprises:

a first timing belt provided so as to be revolvable in the front-back direction and a second timing belt that is provided so as to be revolvable in the front-back direction and that comprises a path of revolution in an extension of a path of revolution of the first timing belt;

the first movable member is fixed to the corresponding first timing belt;

the second movable member is fixed to the corresponding second timing belt;

a rod-shaped joint member serving as the first space holding means is interposed between the first movable member and the second movable member; and the first actuation block comprises a first motor for revolving the first timing belt and a second motor for revolving the second timing belt.

9. The sewing frame actuator for a sewing machine according to claim 8, wherein each of the fifth movable members is moved by a ball screw mechanism or a timing belt mechanism that is actuated by the third actuation block.

10. The sewing frame actuator for a sewing machine according to claim 8, wherein the support comprises a timing belt provided so as to be revolvable in the front-back direction;

the third movable member and the fourth movable member are secured to the timing belt for a second front-back direction actuation block;

a rod-shaped joint member serving as second space holding means is interposed between the third movable member and the fourth movable member; and the second actuation block revolves the timing belt for a second front-back direction actuation block.

11. The sewing frame actuator for a sewing machine according to claim 2, wherein each of the first front-back direction actuation blocks comprises a timing belt provided so as to be revolvable in the front-back direction;

the first movable member and the second movable member are secured to the timing belt;

a rod-shaped joint member serving as the first space holding means is interposed between the first movable member and the second movable member; and the first actuation block revolves the timing belt.

12. The sewing frame actuator for a sewing machine according to claim 2, wherein the support comprises:

a third timing belt provided so as to be revolvable in the front-back direction and a fourth timing belt that is provided so as to be revolvable in the front-back direction and that comprises a path of revolution in an extension of a path of revolution of the third timing belt;

and wherein the third movable member is secured to the third timing belt;

the fourth movable member is secured to the fourth timing belt;

a rod-shaped joint member serving as second space holding means is interposed between the third movable member and the fourth movable member; and the second actuation block comprises a third motor for revolving the third timing belt and a fourth motor for revolving the fourth timing belt.

13. The sewing frame actuator for a sewing machine according to claim 2, wherein the support comprises a timing belt provided so as to be revolvable in the front-back direction;

the third movable member and the fourth movable member are secured to the timing belt for a second front-back direction actuation block;

a rod-shaped joint member serving as second space holding means is interposed between the third movable member and the fourth movable member; and the second actuation block revolves the timing belt for a second front-back direction actuation block.

14. The sewing frame actuator for a sewing machine according to claim 2, wherein the fifth movable member is moved by a ball screw mechanism or a timing belt mechanism that is actuated by the third actuation block.

15. The sewing frame actuator for a sewing machine according to claim 2, the right-left direction actuation blocks are provided on the pair of short sides;

each of the right-left direction actuation blocks comprises a fifth ball screw provided in a rotatable manner along the right-left direction;

the fifth ball screw is rotated by a fifth motor that is provided on each of the right-left direction actuation blocks and that serves as the third actuation block; and the fifth movable member is screw-engaged with the fifth ball screw and moves in the right-left direction.

16. The sewing frame actuator for a sewing machine according to claim 2, wherein the right-left direction actuation blocks are provided on the pair of short sides;

each of the right-left direction actuation blocks comprises a fifth timing belt provided so as to be revolvable in the right-left direction;

the fifth timing belt is rotated by a fifth motor that serves as the third actuation block; and the fifth movable member provided on the right-left direction actuation blocks is fastened to the fifth timing belt and moves in the right-left direction.

17. The sewing frame actuator for a sewing machine according to claim 1, wherein the fifth movable member is moved by a ball screw mechanism or a timing belt mechanism that is actuated by the third actuation block.

18. The sewing frame actuator for a sewing machine according to claim 1, wherein the right-left direction actuation blocks are provided on the pair of short sides;

each of the right-left direction actuation blocks comprises a fifth ball screw provided in a rotatable manner along the right-left direction;

the fifth ball screw is rotated by a fifth motor that is provided on each of the right-left direction actuation blocks and that serves as the third actuation block; and the fifth movable member is screw-engaged with the fifth ball screw and moves in the right-left direction.

19. The sewing frame actuator for a sewing machine according to claim 1, wherein the right-left direction actuation blocks are provided on the pair of short sides;

each of the right-left direction actuation blocks comprises a fifth timing belt provided so as to be revolvable in the right-left direction;

the fifth timing belt is rotated by a fifth motor that serves as the third actuation block; and the fifth movable member provided on the right-left direction actuation blocks is fastened to the fifth timing belt and moves in the right-left direction.

20. A sewing frame actuator for a sewing machine which actuates a sewing frame in a square shape with a pair of long sides and a pair of short sides, the actuator comprising:

front-back direction actuation blocks which actuate the sewing frame in a front-back direction and are laid along the pair of short sides of the sewing frame; and right-left direction actuation blocks which actuate the sewing frame in the right-left direction and are laid along the pair of short sides of the sewing frame, wherein each of the front-back direction actuation blocks comprises: movable members connected to corners of the sewing frame by connection members and moved in the front-back direction by actuation blocks; and a support that supports the movable members and the actuation blocks, and each of the right-left direction actuation blocks comprises a movable member holding the support from below.

* * * * *